US010896795B2

(12) United States Patent
McRae

(10) Patent No.: US 10,896,795 B2
(45) Date of Patent: Jan. 19, 2021

(54) SYSTEM, APPARATUS, AND METHOD FOR GROUNDING AND PROVIDING AN ELECTRICAL SAFETY CIRCUIT

(71) Applicant: National Tree Company, Cranford, NJ (US)

(72) Inventor: Michael M. McRae, Ormond Beach, FL (US)

(73) Assignee: National Christmas Products LLC, Cranford, NJ (US)

( * ) Notice: Subject to any disclaimer, the term of this patent is extended or adjusted under 35 U.S.C. 154(b) by 0 days.

(21) Appl. No.: 16/838,723

(22) Filed: Apr. 2, 2020

(65) Prior Publication Data

US 2020/0234904 A1 Jul. 23, 2020

Related U.S. Application Data

(63) Continuation-in-part of application No. 16/820,151, filed on Mar. 16, 2020, and a continuation-in-part of application No. 16/681,504, filed on Nov. 12, 2019, which is a continuation-in-part of application No. 16/444,715, filed on Jun. 18, 2019, which is a continuation-in-part of application No. 16/286,403, filed on Feb. 26, 2019, which is a continuation-in-part of application No. 15/996,284, filed on Jun. 1, 2018, (Continued)

(51) Int. Cl.

| | |
|---|---|
| ***H01H 71/00*** | (2006.01) |
| ***H01H 71/08*** | (2006.01) |
| *A47G 33/12* | (2006.01) |

(52) U.S. Cl.

CPC ..... *H01H 71/002* (2013.01); *H01H 71/08* (2013.01); *A47G 2033/122* (2013.01)

(58) Field of Classification Search

CPC ..... H01H 71/002; H01H 71/08; A47G 33/06; A47G 33/12; A47G 33/1213; A47G 2033/122; A47G 33/126; A47G 33/1206; E04H 12/22; E04H 12/2238; E04H 12/2253; E04H 12/2284; E04H 12/2269; H01R 13/648

USPC ..... 248/519

See application file for complete search history.

(56) References Cited

U.S. PATENT DOCUMENTS 4,364,102 A * 12/1982 Huppert ..... A47G 33/06 362/122

5,106,042 A * 4/1992 Sloane ..... A47F 5/04 248/121

(Continued)

*Primary Examiner* — Christopher Garft

(74) *Attorney, Agent, or Firm* — Ellenoff Grossman & Schole LLP; James M. Smedley; Alex Korona

(57) ABSTRACT

An apparatus is disclosed. The apparatus has a decorative assembly stand including an assembly supporting a movable assembly, the movable assembly having a cavity, a decorative assembly member that is configured to be removably received in the cavity, a coating that coats a surface of the decorative assembly member, a first fastener, and a second fastener configured to be removably electrically connected to the first fastener. The second fastener is electrically connected to the movable assembly. The first fastener is configured to be received in an aperture of the movable assembly and cut through the coating of the decorative assembly member and contact the surface of the decorative assembly member when the decorative assembly member is received in the cavity of the movable assembly.

20 Claims, 22 Drawing Sheets

Related U.S. Application Data which is a continuation-in-part of application No. 15/707,802, filed on Sep. 18, 2017, now Pat. No. 9,991,648, which is a continuation-in-part of application No. 15/490,880, filed on Apr. 18, 2017, now Pat. No. 9,876,287.

(56) References Cited

U.S. PATENT DOCUMENTS

| | | | | | |
|---|---|---|---|---|---|
| 5,190,261 | A * | 3/1993 | Tetting | A47G 33/126 | 211/163 |
| 5,713,554 | A * | 2/1998 | Lai | A47G 33/126 | 248/519 |
| 5,878,989 | A * | 3/1999 | Allman | A47G 33/126 | 211/163 |
| 6,739,566 | B1 * | 5/2004 | Kao | A47G 33/126 | 248/519 |
| 6,886,296 | B1 * | 5/2005 | John | E02D 5/60 | 248/519 |
| 2015/0375694 | A1 * | 12/2015 | Stojkovic | B21D 26/035 | 29/825 |
| 2016/0192798 | A1 * | 7/2016 | Leung | A47G 33/1206 | 248/528 |
| 2020/0220304 | A1 * | 7/2020 | McRae | H01R 4/643 | |

* cited by examiner

SYSTEM, APPARATUS, AND METHOD FOR GROUNDING AND PROVIDING AN ELECTRICAL SAFETY CIRCUIT

CROSS-REFERENCE TO RELATED APPLICATIONS

This application is a continuation-in part of U.S. nonprovisional patent application Ser. No. 16/681,504 filed on Nov. 12, 2019 and entitled "System, Apparatus, and Method for Providing an Electrical Safety Circuit," which is a continuation-in part of U.S. nonprovisional patent application Ser. No. 16/444,715 filed on Jun. 18, 2019 and entitled "System, Apparatus, and Method for Providing an Electrical Safety Circuit;" and is also a continuation-in-part of U.S. nonprovisional patent application Ser. No. 16/820,151 filed on Mar. 16, 2020 and entitled "Safety Grounded Artificial Tree Stand," which is a continuation-in-part of U.S. Non-Provisional Utility patent application Ser. No. 16/286,403 filed on Feb. 26, 2019 and entitled "Safety Grounded Tree External Wiring," which is a continuation-in-part of U.S. Non-Provisional Utility patent application Ser. No. 15/996,284, filed on Jun. 1, 2018 and entitled "Electrical Plug for a Safety Grounded Tree," which is a continuation-in-part of U.S. Non-Provisional Utility patent application Ser. No. 15/707,802, filed on Sep. 18, 2017 and entitled "An Electrical Plug for a Safety Grounded Tree," which is a continuation-in-part of U.S. Non-Provisional Utility patent application Ser. No. 15/490,880, filed on Apr. 18, 2017 and entitled "Electrical Plug and Socket Assembly for a Safety Grounded Tree," the entire disclosure of which is incorporated herein by reference.

TECHNICAL FIELD

The present disclosure generally relates to a system, apparatus, and method for providing a circuit, and more particularly to a system, apparatus, and method for providing an electrical safety circuit.

BACKGROUND

Artificial illumination includes light that is not natural light. Artificial light may be a product of human creative activity. Some artificial light may be employed for decoration, safety, or convenience. In some scenarios, decorative light displays may involve illumination of many lights.

Users of illuminated artificial lights include individuals and organizations. Some decorative artificial lights may be utilized during holidays or special occasions. Some holiday seasons during which artificial light is used may last weeks or months.

Artificial light assemblies such as artificial trees may be grounded. Some conventional techniques for grounding artificial trees include metal center poles or wire branches including internally-wired and/or externally-wired lighting and decorative items. However, conventional grounding techniques typically are not effective on some artificial trees such as, for example, a rotating tree stand.

The exemplary disclosed system, apparatus, and method are directed to overcoming one or more of the shortcomings set forth above and/or other deficiencies in existing technology.

SUMMARY OF THE DISCLOSURE

In one exemplary aspect, the present disclosure is directed an apparatus. The apparatus includes a decorative assembly stand including an assembly supporting a movable assembly, the movable assembly having a cavity, a decorative assembly member that is configured to be removably received in the cavity, a coating that coats a surface of the decorative assembly member, a first fastener, and a second fastener configured to be removably electrically connected to the first fastener. The second fastener is electrically connected to the movable assembly. The first fastener is configured to be received in an aperture of the movable assembly and cut through the coating of the decorative assembly member and contact the surface of the decorative assembly member when the decorative assembly member is received in the cavity of the movable assembly.

In another exemplary aspect, the present disclosure is directed to a method. The method includes providing a decorative assembly stand including an assembly supporting a movable assembly, the movable assembly having a cavity, removably inserting a decorative assembly member in the cavity of the movable assembly, the surface of the decorative assembly member being coated with a coating, inserting a first fastener through an aperture of the movable assembly when the decorative assembly member is inserted in the cavity of the movable assembly, cutting through the coating of the decorative assembly member with the first fastener and contacting the surface of the decorative assembly member when the first fastener is inserted in the aperture of the movable assembly and the decorative assembly member is inserted in the cavity of the movable assembly, and removably electrically connecting a second fastener to the first fastener. The second fastener is electrically connected to the movable assembly.

In another exemplary aspect, the present disclosure is directed to an apparatus. The apparatus includes a base assembly, a movable assembly that is movably supported by the base assembly and that is movable relative to the base assembly, a structural assembly that is supported by the movable assembly, a plurality of electrical assemblies supported by the structural assembly, and a first electrical connector that is electrically connectable to some of the plurality of electrical assemblies, the first electrical connector being attached to the movable assembly and including a first plurality of electrical members. The apparatus also includes a second electrical connector that is electrically connectable to a power source, the second electrical connector being attached to the base assembly and including a second plurality of electrical members, and one or more contact members that are movably disposed relative to the base assembly, the one or more contact members moving relative to the base assembly when the movable assembly moves relative to the base assembly. The first plurality of electrical members and the second plurality of electrical members remain electrically connected via the one or more contact members when the one or more contact members moves relative to the base assembly when the movable assembly moves relative to the base assembly.

In another exemplary aspect, the present disclosure is directed to an apparatus. The apparatus includes a base assembly including at least one first elongated recess having a first conductive surface, a rotatable assembly that is rotatably supported by the base assembly and that is rotatable relative to the base assembly, the rotatable assembly including at least one second elongated recess having a second conductive surface that faces the first conductive surface, a structural assembly that is supported by the rotatable assembly, a plurality of electrical assemblies supported by the structural assembly, and a first electrical connector that is electrically connectable to some of the plurality of electrical assemblies, the first electrical connector being attached to the rotatable assembly and including a first plurality of electrical members. The apparatus also includes a second electrical connector that is electrically connectable to a power source, the second electrical connector being attached to the base assembly and including a second plurality of electrical members, and one or more contact members that are movably disposed in a cavity formed between the first and second conductive surfaces, the one or more contact members movable along the cavity when the movable assembly moves relative to the base assembly. The first plurality of electrical members and the second plurality of electrical members remain electrically connected via the first and second conductive surfaces and the one or more contact members when the movable assembly moves relative to the base assembly.

DETAILED DESCRIPTION AND INDUSTRIAL APPLICABILITY

Figure 1:
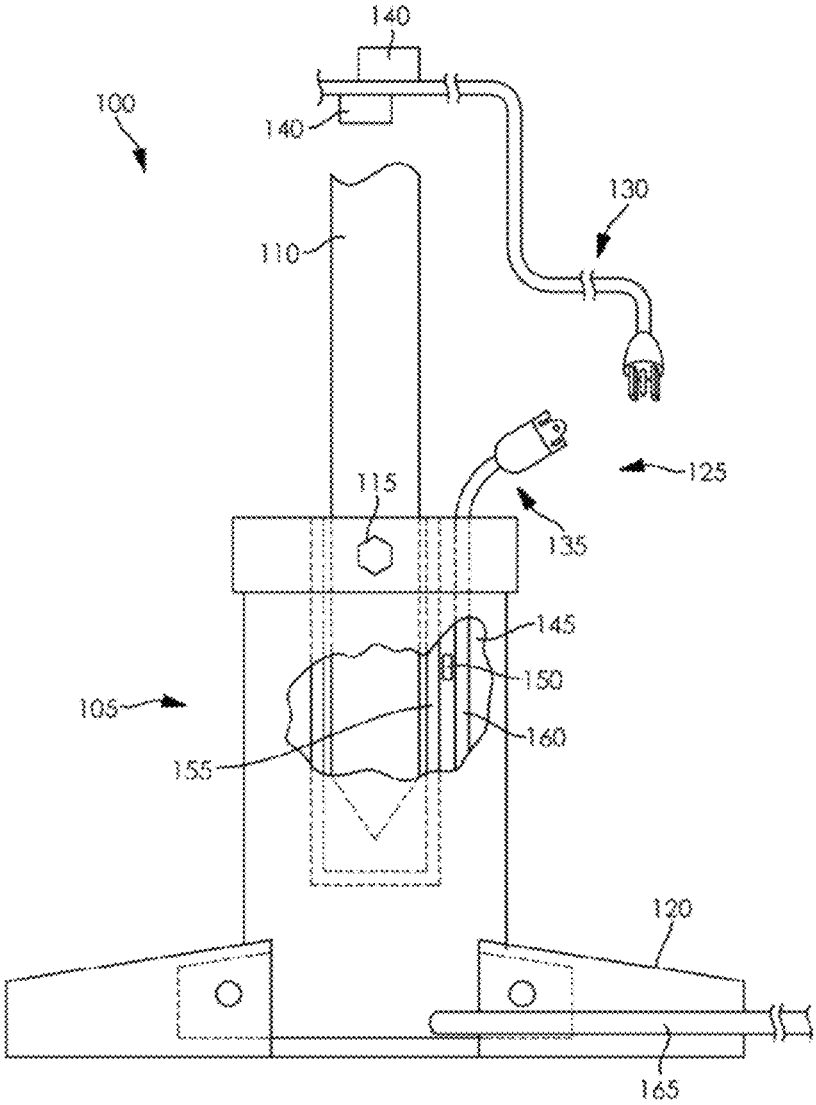
FIG. 1 illustrates a side view of at least some exemplary embodiments of the present disclosure.

The exemplary disclosed system, apparatus, and method may provide an electrical safety circuit. For example, the exemplary disclosed system, apparatus, and method may be used in any suitable application for grounding an electrical device. In at least some exemplary embodiments, the exemplary disclosed system, apparatus, and method may be used in any application involving grounding a decorative lighting assembly and/or any other suitable device that may be grounded. For example, the exemplary disclosed system, apparatus, and method may be used in any suitable application for providing an electrical safety circuit for a rotating artificial tree stand.

In at least some exemplary embodiments, the exemplary disclosed system may include a 3-wire safety rotary base for artificial trees that has a 3-wire AC (alternating current) grounding feature. For example, the exemplary disclosed system may allow for a grounded tree to be able to be used with a rotating tree stand. In at least some exemplary embodiments, the exemplary disclosed system may include a rotary stand that includes a 3-wire safety circuit.

In at least some exemplary embodiments, the exemplary disclosed system may include rotary bases or stands having a 3-wire safety AC circuit for the grounded trees. For example, the exemplary disclosed system may include a rotating artificial tree having a 3-wire safety socket that allows a 3-wire safety plug to be connected for trees that have a safety grounded pole. The exemplary disclosed system may include an AC socket for a 3-wire safety connection.

In at least some exemplary embodiments, the exemplary disclosed system may include a stand that is a round pot style tree stand. The exemplary disclosed system may also include a rotary stand that provides a grounded 3-wire socket and also a DC (direct current) socket for one or more low voltage decorative elements disposed on an artificial tree or other exemplary assembly.

In at least some exemplary embodiments, the exemplary disclosed system may include a rotary tree stand that is configured to receive (e.g., accept) a full-size artificial tree that may be disposed (e.g., placed) on and/or in the rotary base. The exemplary disclosed rotary stand base may include a safety 3-wire grounding system and electronic components that may control a rotation function of the base and tree. The exemplary disclosed system may also provide low voltage DC voltage output for decorative items such as LEDs (e.g., light-emitting diode elements). The exemplary disclosed system may further provide an external switch to control lighting patterns of the exemplary low voltage output.

In at least some exemplary embodiments, the exemplary disclosed system may include a rotary stand having a Wi-Fi/Bluetooth system including a Wi-Fi/Bluetooth receiver. The exemplary Wi-Fi/Bluetooth receiver may provide remote control of rotary functions of the rotary stand and DC lighting signals for LED display variations of the exemplary disclosed system. The exemplary Wi-Fi/Bluetooth system may also connect to an audio system (e.g., recording and replay audio system) for storage and replaying of messages and songs from any suitable device (e.g., computers, smart devices such as smart phones, tablets, systems such as Alexa, and/or Google-type devices). In at least some exemplary embodiments, the exemplary disclosed system may provide a Bluetooth function to the exemplary stand (e.g., rotary stand) to allow remote control of rotary functions of the rotary stand, remote control of the exemplary disclosed DC LED lighting displays, and/or audio replication of messages and music from user devices such as smart devices.

FIG. 1 illustrates an exemplary system 100. System 100 may be a decorative system such as an artificial tree system including a plurality of lighting elements. Exemplary system 100 may include an assembly 105 and a member 110. Assembly 105 may be a rotary stand. Assembly 105 may be for example a stand for an artificial lighting arrangement. For example, assembly 105 may be an artificial tree stand. In at least some exemplary embodiments, assembly 105 may be a rotary artificial tree stand. Member 110 may be an elongated member that may be removably attached (e.g., or permanently attached) to assembly 105. For example, member 110 may be a pole such as a metal pole of an artificial tree or any other suitable lighting arrangement member. Member 110 may be fastened to assembly 105 via a fastener 115. Fastener 115 may be any suitable fastening device for attaching member 110 to assembly 105 such as, for example, a bolt (e.g., securing bolt), a screw, and/or any other suitable mechanical fastener (e.g., or any other suitable fastener such as a magnetic fastener, a hook and loop fastener, an adhesive material, and/or any other suitable fastening device). In at least some exemplary embodiments, fastener 115 may be a securing bolt having a pointed portion (e.g., sharp point) that may make contact with a surface of member 110. Assembly 105 may include a plurality of members 120 that may be legs or any other suitable structural members for maintaining assembly 105 in a stable (e.g., stationary) position.

System 100 may include an electrical system 125. Electrical system 125 may include an electrical component 130 and an electrical component 135. Electrical component 130 may be an electrical plug. For example, electrical component 130 may be a 3-wire plug having a fuse. Electrical component may be electrically connected to one or more electrical elements 140 that may be for example lighting elements (e.g., LEDs of an artificial tree or other suitable electrically-powered elements of an assembly). For example, electrical elements 140 may be LED lighting assemblies, incandescent lighting assemblies, halogen lighting assemblies, and/or any other desired type of lighting assembly or electrical decoration. Electrical components 130 and/or 135 may ground electrical elements 140 to member 110.

Electrical component 130 may be removably attachable to electrical component 135. For example, electrical component 135 may be an electrical socket (e.g., 3-wire socket) that removably receives electrical component 130 that may be a 3-wire plug. Each of electrical components 130 and 135 may include an additional safety wire (e.g., a third wire added to a 2-wire system) that may be added to a circuit to provide a safety ground socket for grounded electrical systems such as grounded artificial trees.

Electrical component 135 may include AC (alternating current) leads 145. Electrical component 135 may also include a connection portion 150. Connection portion 150 may be a safety ground bond that may connect electrical component 135 to a portion 155 of assembly 105 (e.g., to portion 155 such as a metal trunk stand tube of assembly 105). Electrical component 135 may include a ground wire 160. In at least some exemplary embodiments, electrical component 135 may be a 3-wire safety socket that may be attached to electrical component 130 that may be a plug from a grounded artificial tree. Ground wire 160 may be an additional safety wire (e.g., a third wire added to a 2-wire system) that may be electrically connected (e.g., receive in an electrical circuit) in a manner similar to a slip ring or spring loaded contact to a ring contact strip. For example, ground wire 160 may be electrically connected in a similar manner as a 2-wire system to which ground wire 160 may be incorporated as an additional safety wire.

Electrical system 125 may also include an electrical component 165. Electrical component 165 may be a 3-wire power lead. Electrical component 130, electrical component 135, and electrical component 165 may be electrically connected to provide power to components of system 100. Electrical component 135 and electrical component 165 may be integral portions of the same component or may be removably attached or fixedly attached to each other.

Figure 2:
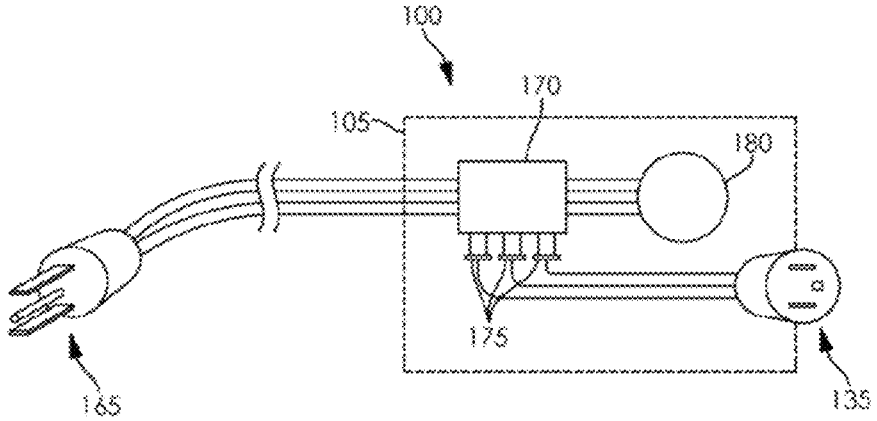
FIG. 2 illustrates a schematic view of at least some exemplary embodiments of the present disclosure.

FIG. 2 schematically illustrates a circuit diagram of an exemplary disclosed circuit of system 100 of FIG. 1, including assembly 105 (e.g., a rotary artificial tree stand as illustrated in FIG. 1). As illustrated in FIG. 2, the exemplary disclosed circuit of system 100 may be a 3-wire safety ground circuit including electrical component 165 (e.g., a 3-wire safety AC plug) and electrical component 135 (e.g., an AC outlet such as a 3-wire AC socket). Additionally for example, one or more contactors 170 that may be conductive spring-loaded contactors may be electrically connected to an actuator 180 (e.g., motor) that may be similar to the exemplary actuator described below regarding FIG. 3. Contactor 170 may include one or more contact strips 175. Contactor 170 and a plurality of ring conductors disposed in assembly 105 may make electrical contact (e.g., when assembly 105 includes a rotatable assembly that rotates as described for example below regarding FIG. 3).

Figure 3:
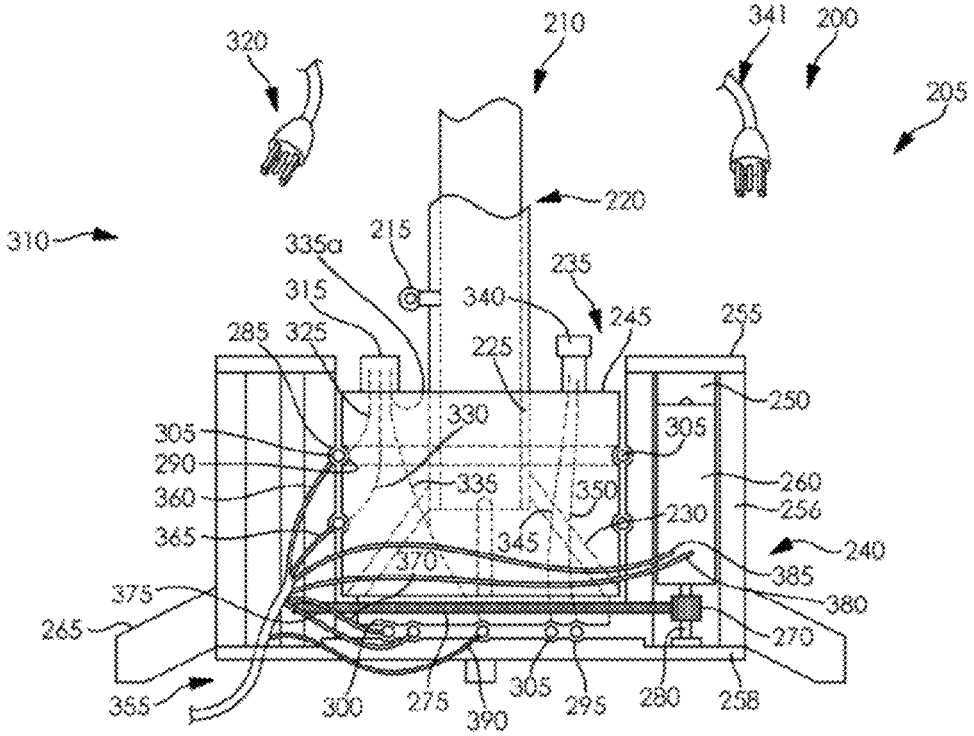
FIG. 3 illustrates a side view of at least some exemplary embodiments of the present disclosure.

FIG. 3 illustrates an exemplary system 200. Exemplary system 200 may include an assembly 205 and a member 210 that may be generally similar to member 110. Member 210 may be fastened to assembly 205 via a fastener 215 that may be generally similar to fastener 115. For example, assembly 205 may include a housing 220 that may be configured to receive member 210. Housing 220 may be a pole tube such as a tree pole tube. Housing 220 may include a plurality of members (e.g., tube member 225) configured to receive and maintain member 210 in a stationary position. Assembly 205 may also include a plurality of support members 230 (e.g., forming a tree stand structure) that may structurally support tube member 225. In at least some exemplary embodiments, assembly 205 may be an artificial tree rotary base configured as a round pot style stand for supporting small artificial trees.

Assembly 205 may include a movable assembly (e.g., movable in any direction) such as rotatable assembly 235 and a base assembly 240. Base assembly 240 may be for example a stand structure that supports rotatable assembly 235. Rotatable assembly 235 may for example include housing 220 and support members 230. For example, housing 220 and support members 230 may be supported within a rotatable housing 245 of rotatable assembly 235. Rotatable assembly 235 may be movably disposed on or in base assembly 240. For example, rotatable assembly 235 may be rotatably disposed on or in base assembly 240. Base assembly 240 may include one or more members 265 that may be similar to member 120.

Base assembly 240 may be a housing in which one or more cavities 250 are formed. One or more cavities 250 may be formed by one or more cover members 255, one or more side members 256, and one or more bottom members 258. One or more cover members 255 may be removably attached to one or more side members 256 of base assembly 240 to selectively access cavity 250. An actuator 260 may be disposed in cavity 250 or located at any other suitable portion of assembly 205. Actuator 260 may be a motor (e.g., an electrical motor or any other suitable type of electromechanical, mechanical, hydraulic, pneumatic, magnetic, and/or any other suitable device for selectively moving rotatable assembly 235). Actuator 260 may selectively move a plurality of movable members 270 and 275. For example, movable members 270 and 275 may be a plurality of gears configured to be actuated by actuator 260 to move rotatable assembly 235 on or in base assembly 240. For example, movable member 270 may be attached to a shaft 280 actuated by actuator 260. Movable member 270 may engage with movable member 275 that may be attached to rotatable assembly 235, thereby moving (e.g., rotating) rotatable assembly 235 on or in base assembly 240. In at least some exemplary embodiments, actuator 260 may be a rotational motor that is mounted (e.g., vertically mounted) on a side of base assembly 240 (e.g., a pot). Actuator 260 may move movable members 270 and 275 disposed on a bottom of assembly 205.

Base assembly 240 may include a plurality of recesses 285 disposed on surface of base assembly 240 facing a side of rotatable assembly 235. Rotatable assembly 235 may include a plurality of recesses 290 disposed on a surface of rotatable assembly facing recesses 285. Recesses 285 and 290 may face each other and be aligned with each other (e.g., remain aligned as rotatable assembly 235 rotates on or in base assembly 240). Base assembly 240 may also include a plurality of recesses 295 disposed on surface of base assembly 240 facing a bottom of rotatable assembly 235. Rotatable assembly 235 may include a plurality of recesses 300 disposed on a surface of rotatable assembly 235 facing recesses 295. Recesses 295 and 300 may face each other and be aligned with each other (e.g., remain aligned as rotatable assembly 235 rotates on or in base assembly 240). Recesses 285, 290, 295, and 300 may be elongated recesses or grooves formed in conductive material of rotatable assembly 235 and base assembly 240 that may be configured to receive a contact member such as a conductive member 305 (e.g., in cavities formed by respective recesses 285, 290, 295, and 300). For example, recesses 285, 290, 295, and 300 may be conductive bearing rings configured to receive conductive members 305 (e.g., a ball bearing or other suitable conductive member). Conductive members 305 may be configured to fit within cavities formed between recesses 285 and 290 or between recesses 295 and 300. Conductive members 305 may be conductive ball bearings that provide electrical contact between components of assembly 205 (e.g., between rotatable assembly 235 and base assembly 240). Such exemplary electrical contact may also be provided via slip rings and/or any other suitable technique for making electrical connection (e.g., conductive members 305 may be slip rings).

System 200 may include an electrical system 310 that may have components that are generally similar to components of electrical system 125. Electrical system 310 may include an electrical connector such as an electrical component 315 that may be generally similar to electrical component 135. For example, electrical component 315 may be 3-wire safety end socket that may be removably attachable to an electrical component 320 that may be similar to electrical component 130. As illustrated in FIG. 3, electrical component 315 may be electrically connected to conductive surfaces of recesses 290 via electrical members 325 and 330 (e.g., electrical wires or other suitable members for electrically connecting components). Electrical component 315 may also be electrically connected to conductive surfaces of recesses 300 via electrical member 335 that may be similar to electrical members 325 and 330. Electrical member 335 may be for example a third wire that may be similar to ground wire 160. Electrical member 335 may include an electrical member **335*a* that may be a third wire safety as illustrated in FIG. 3**.

Electrical system 310 may also include an electrical component 340. Electrical component 340 may be for example a DC (direct current) connector such as a female DC connector for LEDs or any other suitable electrical component. As illustrated in FIG. 3, electrical component 340 may be electrically connected to conductive surfaces of recesses 300 via electrical members 345 and 350 that may be similar to electrical members 325 and 330. Electrical members 345 and 350 may be electrically connected via conductive members 305 to electrical members disposed in base assembly 240 and electrically connected as described below regarding FIG. 4 (e.g., electrically connected to a switch as described below). Returning to FIG. 3, electrical component 340 may form part of a DC circuit and socket for electrical components such as low voltage lighting components (e.g., decorations such as holiday decorations) and LED lighting. Electrical component 340 may be a DC socket configured to receive an electrical component 341 (e.g., having DC leads from low voltage lighting components).

Electrical system 310 may further include an electrical connector such as an electrical component 355. Electrical component 355 may provide electrical current from a power source and/or control assembly (e.g., controller such as a microcontroller or other suitable electrical or electro-mechanical control assembly). For example, electrical component 355 may provide AC and/or DC electric power from a power source and/or controller (e.g., from control). Electrical component 355 may be in electrical contact with additional electrical components of system 200 as described below regarding FIG. 4. Returning to FIG. 3, electrical component 355 may be electrically connected to conductive surfaces of recesses 285 via electrical members 360 and 365 that may be similar to electrical members 325 and 330. Electrical members 360 and 365 may be AC leads. As illustrated in FIG. 3, electrical member 360 may be electrically connected via one of recesses 285, one of conductive members 305, and one of recesses 290 to electrical member 325. Also as illustrated in FIG. 3, electrical member 365 may be electrically connected via one of recesses 285, one of conductive members 305, and one of recesses 290 to electrical member 330.

As illustrated in FIG. 3, electrical component 355 may be electrically connected to conductive surfaces of recesses 295 via electrical members 370 and 375 that may be similar to electrical members 325 and 330. Electrical members 370 and 375 may be DC leads. Also as illustrated in FIG. 3, electrical component 355 may be electrically connected to actuator 260 via electrical members 380 and 385 that may be similar to electrical members 325 and 330. Electrical members 380 and 385 may be actuator leads (e.g., motor leads) for powering actuator 260.

As illustrated in FIG. 3, electrical component 355 may be electrically connected to conductive surfaces of one of recesses 295 via an electrical member 390 that may be similar to electrical members 325 and 330. Electrical member 390 may be an AC safety component such as an AC third wire safety end. As illustrated in FIG. 3, electrical member 390 may be electrically connected via one of recesses 295, one of conductive members 305, and one of recesses 300 to electrical member 335. Electrical members 335 and 390 may be electrically connected and may operate as a third wire similar to ground wire 160. Electrical members 335 and 390 may form a safety wire of a grounded 3-wire AC circuit having a 3-wire safety socket.

Figure 4:
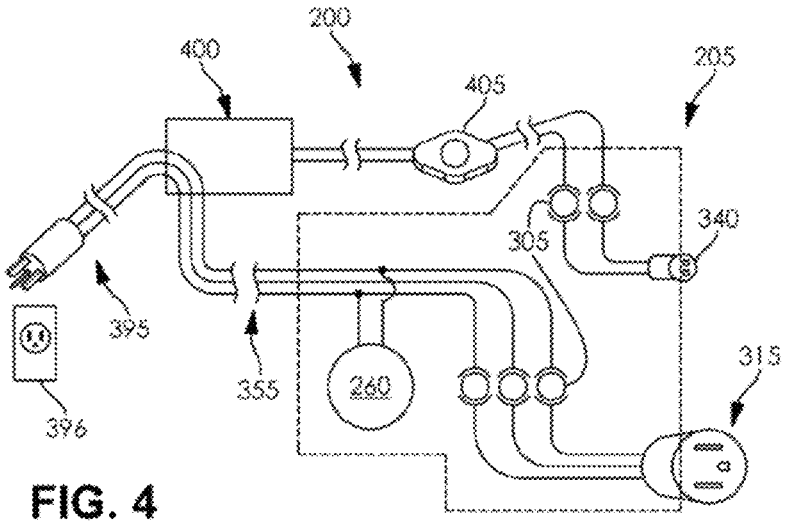
FIG. 4 illustrates a schematic view of at least some exemplary embodiments of the present disclosure.

FIG. 4 schematically illustrates a circuit diagram of an exemplary disclosed circuit of system 200 of FIG. 3, including assembly 205 (e.g., a small round pot rotary artificial tree stand as illustrated in FIG. 3). As illustrated in FIG. 4, the exemplary disclosed circuit of system 200 may be a 3-wire safety ground circuit including electrical component 355, an electrical component 395 (e.g., a 3-wire safety AC plug that may be connected to a power source such as a wall outlet or other suitable power source), electrical component 315 (e.g., an AC outlet such as a 3-wire AC socket), and electrical component 340 (e.g., a DC connector such as a 2-pin DC output). The exemplary disclosed circuit of system 200 may also include an electrical component 400 that may be a power adapter. Electrical component 400 may be electrically connected between electrical component 395 and electrical component 355. Electrical component 395 may be selectively electrically attachable to a power source 396 (e.g., a power outlet such as a wall outlet, a generator, or any other suitable power source such as an electrical power source). Electrical component 400 may be for example an AC/DC, HI/LO adapter that may be used to selectively provide low voltage power based on an operation of a controller (e.g., any suitable controller such as a microcontroller) and any suitable switch. Electrical component 400 may provide varied current and voltages of DC power that is passed through assembly 205 for low voltage DC decorations and/or any other suitable electrical assemblies. Electrical component 400 may provide any suitable current and voltage of AC and/or DC electricity to system 200. As illustrated in FIG. 4 and as described for example above, actuator 260 may be electrically connected to electrical component 355 as well as to other exemplary electrical components. Additionally for example, conductive members 305 (e.g., conductive ball bearings) may make electrical contact between components of assembly 205 and electrical system 310 when rotatable assembly 235 rotates within base assembly 240 as described for example above. The exemplary disclosed circuit of system 200 may also include an electrical component 405 that may be a controller such as a switch (e.g., foot switch or any other suitable controller having a user interface to receive input from a user). Electrical component 405 may be electrically connected to and may be used to control an operation of electrical component 400 and/or other components of electrical system 310 (e.g., control a lighting pattern, rotation, and/or any other suitable operation of assembly 205, exemplary disclosed lighting assemblies of system 200, and/or decorations of system 200).

An exemplary operation of system 200 illustrated in FIGS. 3 and 4 will now be described. A user may selectively control an operation of system 200 using electrical component 405 (e.g., a switch). Electrical component 405 may provide input to electrical component 400 (e.g., an adaptor) and components of assembly 205 (e.g., actuator 260) to control a lighting pattern, rotation, and/or any other suitable operation of system 200. For example, actuator 260 may be selectively controlled to rotate shaft 280 and movable member 270, which may engage with movable member 275 that may be attached to rotatable assembly 235. Rotatable assembly 235 may thereby be rotated on or in base assembly 240. As rotatable assembly 235 rotates, conductive members 305 (e.g., ball bearings) may be retained (e.g., movably retained) between recesses 285 and 290 and between recesses 295 and 300, thereby maintaining electrical contact between components of electrical system 310 disposed in or at rotatable assembly 235 and base assembly 240 as rotatable assembly 235 rotates (e.g., conductive members 305 may move within the cavities formed by the exemplary disclosed recesses). A 3-wire safety circuit may thereby be provided (e.g., by electrical connection between electrical component 315 and electrical component 355 (e.g., and electrical component 395) as described above, as well as between other electrical components as described above during a rotation of components of system 200.

Figure 5:
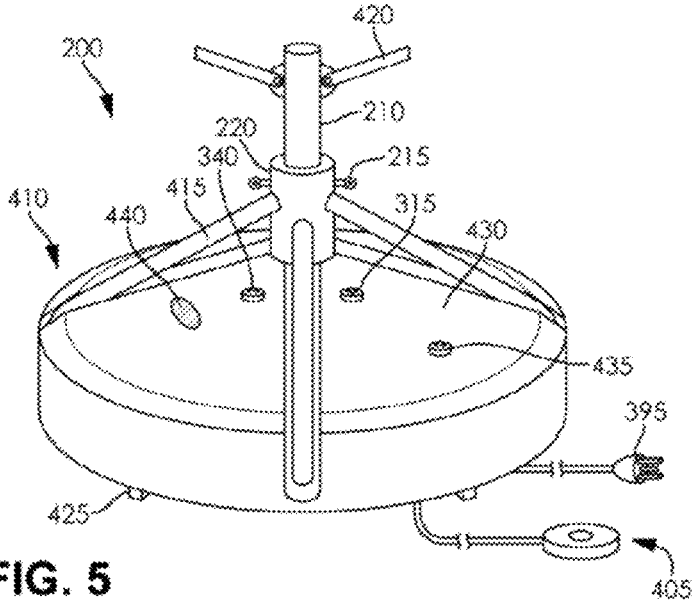
FIG. 5 illustrates a perspective view of at least some exemplary embodiments of the present disclosure.

As illustrated in FIG. 5, system 200 may include a base cover assembly 410 of assembly 205. Base cover assembly 410 may be a rotating tree stand base. Base cover assembly 410 may be a separate member that may be disposed over base assembly 240 and rotatable assembly 235. It is also contemplated that base cover assembly 410 may be an integral part of base assembly 240 and/or may be used with the other exemplary embodiments described herein. Base cover assembly 410 may include a plurality of members 415 that may be structural members such as struts that help support housing 220. Assembly 205 may thereby maintain member 210 that may have a plurality of members 420 (e.g., decorative components such as tree branches when system 200 is an artificial tree system). Member 210 may be a grounded member such as a grounded artificial tree pole. Housing 220, members 415, and members 420 may form a tree stand such as a 4-legged tree stand. Base cover assembly 410 may include a plurality of support members 425 (such as a leg, foot, or other structural member) for supporting system 200. Base cover assembly 410 may include apertures at a top surface 430 at which electrical component 315 (e.g., a 3-wire AC safety socket) and electrical component 340 (e.g., a DC plug) may be mounted and be accessible. FIG. 5 also illustrates electrical component 395 (e.g., an AC 3-wire safety plug with cord) and electrical component 405 (e.g., a DC switch and cord) to allow a user to sequence a display of DC decoration display components (e.g., disposed on members 420) and/or rotary functions of actuator 260 (e.g., a tree motor). Additionally as illustrated in FIG. 5, system 200 may include a Wi-Fi/Bluetooth system having a communication component 435 such as a receiver (e.g., a Wi-Fi/Bluetooth receiver) and an audio component 440 (e.g., a speaker of an audio system). Communication component 435 may provide remote control of rotary functions of assembly 205 and DC lighting signals for LED display variations of system 200. The exemplary disclosed Wi-Fi/Bluetooth system may also connect to the exemplary audio system (e.g., recording and replay audio system) for storage and replaying (e.g., via audio component 440) of messages and songs from any suitable device (e.g., computers, smart devices such as smart phones, tablets, systems such as Alexa, and/or Google-type devices).

Figure 6:
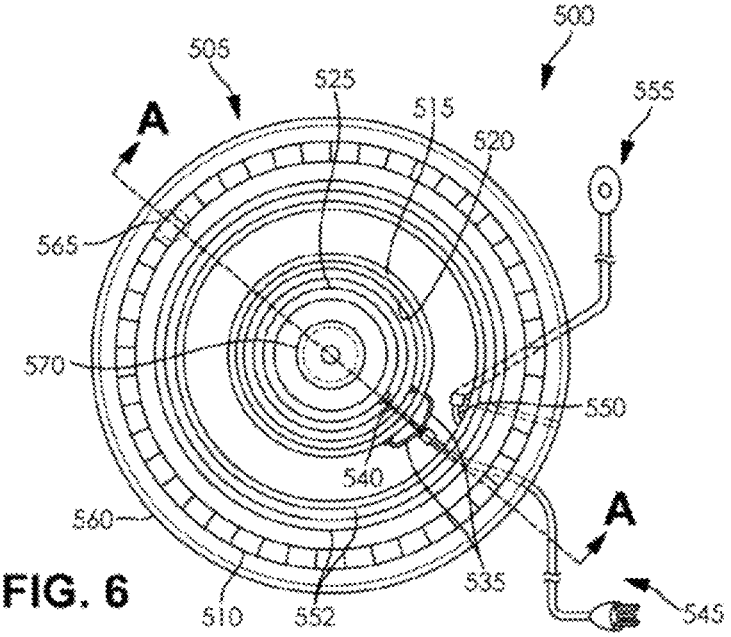
FIG. 6 illustrates a top view of the bottom of a tree stand base of at least some exemplary embodiments of the present disclosure.
Figure 7:
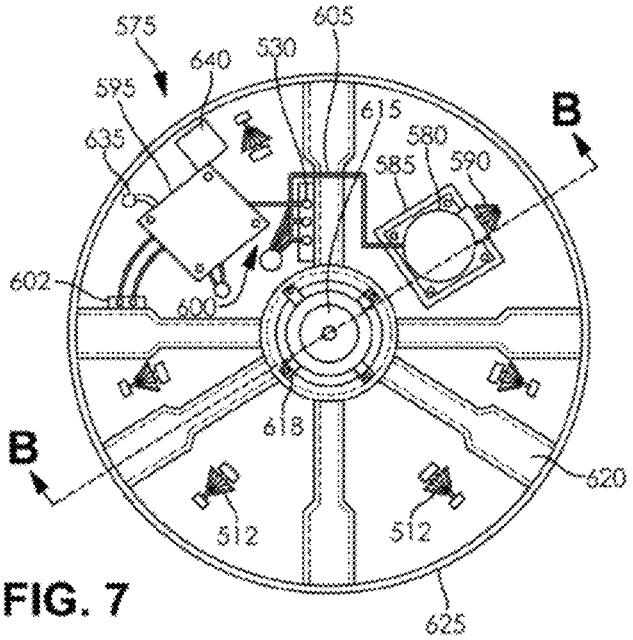
FIG. 7 illustrates a bottom view of the top of a tree stand base of at least some exemplary embodiments of the present disclosure.
Figure 8:
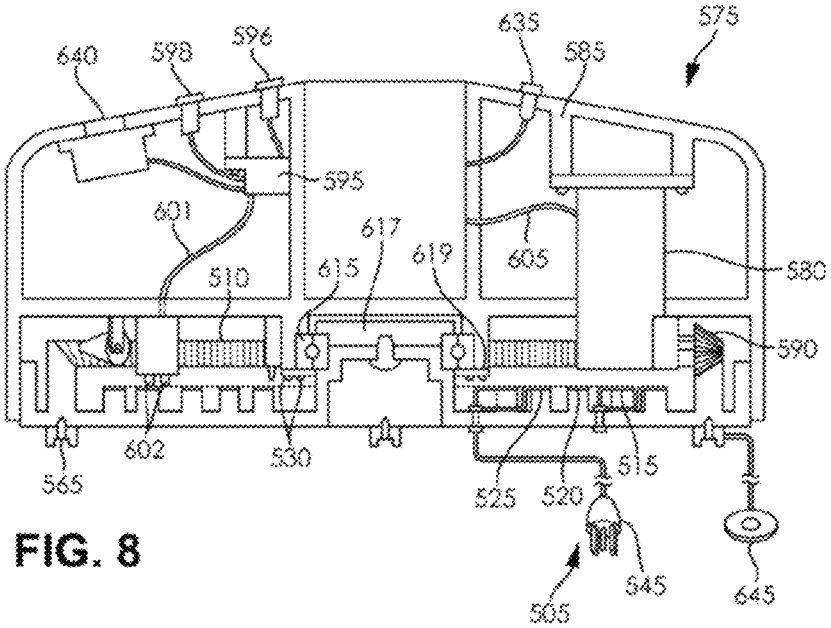
FIG. 8 illustrates a cross-sectional view of at least some exemplary embodiments of the present disclosure.

FIGS. 6-8 illustrate an exemplary system 500. System 500 may include components that may be similar to systems 100 and 200. Components of systems 100, 200, and 500 may be used interchangeably with each other so that exemplary disclosed features of the exemplary disclosed systems may be used together. FIG. 6 illustrates a top view of a base assembly 505 that may be generally similar to portions of assembly 205. As illustrated in FIG. 6, system 500 may include a member 510 (e.g., a circular 45-degree angle bevel gear such as a raised 45-degree gear wheel) that may be configured to engage with a plurality of members 512 illustrated in FIG. 7 (e.g., 45-degree bevel gears some of which may be disposed on a drive motor similar to actuator 260 that may be mounted at a top of base assembly 505). FIG. 6 also illustrates protrusions (e.g., raised portions) such as a portion 515, a portion 520, and a portion 525 that may be raised elongated portions (e.g., circular raised sections). Portions 515, 520, and/or 525 may extend elliptically about a center portion of base assembly 505. Portions 515, 520, and 525 may have conductive surfaces that contact one or more contact members such as contacts 530 (e.g., spring-loaded contacts) illustrated in FIG. 7. Portions 515 and 520 may be raised AC contact strips. Portion 525 may be a raised third wire safety AC contact strip. FIG. 6 also illustrates a plurality of electrical members 535 (e.g., wire connections such as AC leads) that may connect to portions 515 and 520 and an electrical member 540 (e.g., wire connection such as a safety ground lead) that may connect to portion 525. Electrical members 535 and electrical member 540 may then exit a bottom portion of base assembly 505 as part of an electrical connector such as an electrical component 545 (e.g., including an AC cable and a 3-wire safety AC plug) that may be generally similar to electrical component 395. Electrical members 550 (e.g., leads such as switch leads) may connect portions 552 (e.g., contacts that may be raised contact strips, for example DC contacts) externally to an electrical component 555 (e.g., including a selector switch and a switch cable that may sequence functions such as rotation of base assembly 505) that may be generally similar to electrical component 405. Base assembly 505 may also include a vertical edge 560 forming an outside of base assembly 505, one or more members 565 (e.g., support member such as a leg support or foot) for supporting base assembly 505, and a portion 570 that may be a bearing lower support surface (e.g., for a component of system 500 such as a member similar to member 210).

FIG. 7 illustrates a bottom view of a base cover assembly 575 (e.g., base top member of a tree stand) of system 500 that may have components that may be generally similar to base cover assembly 410. Base cover assembly 575 may be a movable assembly (e.g., movable in any direction). Base cover assembly 575 and base assembly 505 may engage with each other as illustrated in FIG. 8. FIG. 7 illustrates an actuator 580 (e.g., a vertically-mounted motor such as a 90-degree-mounted gear motor mounted on a support 585 and having a gear 590 that may be a 90-degree gear) that may be similar to actuator 260. Gear 590 may engage with member 510 (e.g., a 45-degree beveled gear that may engage and mate with member 510 that may be a circular gear track disposed at a bottom of base assembly 505). FIG. 7 illustrates contacts 530 (e.g., AC spring contacts such as spring-loaded contactors) that may mate to portions 515, 520, and 525 (e.g., circular conductors disposed at the bottom of base assembly 505 as illustrated in FIG. 6). FIG. 7 also illustrates members 512 (e.g., support bevel gears that may be 90-degree gears each disposed on a gear bearing support) that may provide stabilization support for base cover assembly 575 during rotation. Base cover assembly 575 may thereby rotate on base assembly 505 (e.g., as illustrated in FIG. 8, the surface illustrated in FIG. 7 may be supported on the surface illustrated in FIG. 6). Contacts 530 may be connected to an electrical component 595 (e.g., an electronic control package including a control section) via a plurality of electrical members 600 (e.g., wires) that may be similar to electrical members 325 and 330. Contacts 530 may also be connected to actuator 580 via a plurality of electrical members 605 (e.g., leads such as motor leads) that may be similar to electrical members 325 and 330. The plurality of electrical members 600 may also connect contacts 530 to electrical components similar to as described above (e.g., an electrical connector such as an electrical component 596 as illustrated in FIG. 8 that may be a female 3-wire safety socket that may be similar to electrical component 315, and an electrical component 598 as illustrated in FIG. 8 that may be a DC socket that may be similar to electrical component 340 for low voltage tree display items such as example for LED light strings). As illustrated in FIGS. 7 and 8, electrical component 595 may be connected via electrical members 601 (e.g., DC wires) to a contact 602 that may be a DC pick-up spring contact.

Returning to FIG. 7, base cover assembly 575 may also include a bearing 615 (e.g., a center bearing such as an internal bearing plate). Bearing 615 may be supported by a plurality of support members 618 (e.g., bearing retainers that may include a base bearing clamp 617 and an upper bearing clamp 619 as illustrated in FIG. 8). Returning to FIG. 7, base cover assembly 575 may also include a plurality of cavities 620 that may be tree stand cavities (e.g., valleys). The plurality of cavities 620 may be configured to receive 3-legged stands, 4-legged stands, and/or any other suitable configuration of stands. FIG. 7 illustrates cavities 620 having housing bottoms forming the cavities that extend toward the viewer (e.g., as viewed by the viewer). Base cover assembly 575 may also include a wall member 625 (e.g., vertical lip) forming an exterior wall of base cover assembly 575. Additionally, system 500 may include a Wi-Fi/Bluetooth system having a communication component 635 such as a receiver (e.g., a Wi-Fi/Bluetooth receiver) that may be similar to communication component 435 and an audio component 640 (e.g., a speaker of an audio system) that may be similar to audio component 440. Communication component 635 and audio component 640 may be connected to electrical component 595 and/or directly to each other.

FIG. 8 illustrates a cross-sectional view of sections A-A labeled in FIG. 6 and B-B labeled in FIG. 7. As illustrated in FIG. 8, a bottom of base cover assembly 575 (e.g., as illustrated in FIG. 7) may be disposed on (e.g., mated on) a top of base assembly 505 (e.g., as illustrated in FIG. 6).

Figure 9:
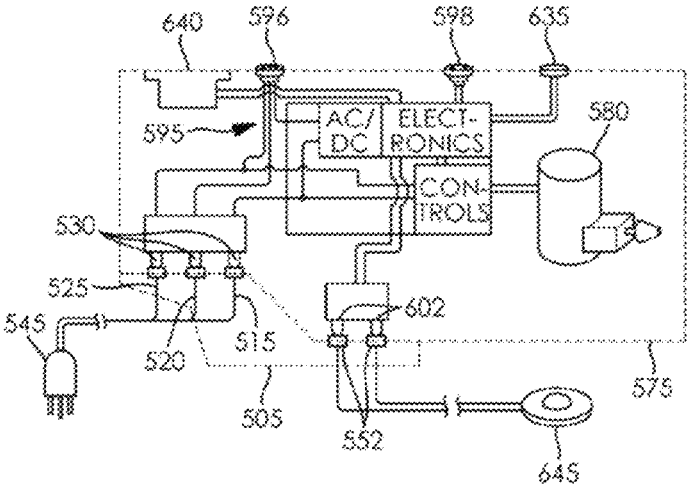
FIG. 9 illustrates a schematic view of at least some exemplary embodiments of the present disclosure.

FIG. 9 schematically illustrates a circuit diagram of an exemplary disclosed circuit of system 500 of FIGS. 6-8, including base assembly 505 and base cover assembly 575 (e.g., forming a rotary artificial stand base). As illustrated in FIG. 9, the exemplary disclosed circuit of system 500 may include electrical component 545 that may be connected to a bottom of base assembly 505 and may be in electrical contact with one or more contacts 530 (e.g., attaching to circular conductor surfaces having spring-loaded contactors) carrying current to electrical component 595. Electrical component 595 may include an electronics box where the AC electricity connects to an AC/DC Hi/Lo adapter (e.g., that may be similar to electrical component 400) that supplies DC electricity for electronics and motor controls as illustrated in FIG. 9. Electrical component 595 may control a display of low voltage items that may be plugged into electrical component 598 (e.g., a DC socket). FIG. 9 also illustrates the connection of AC power to electrical component 596 (e.g., an AC 3-wire safety socket that may be mounted in base cover assembly 575 as described for example above). FIG. 9 also illustrates the further exemplary connection of AC to actuator 580 for rotatable operation of system 500. FIG. 9 also illustrates an electrical component 645 (e.g., a DC switch) that may be similar to electrical component 405 and may be electrically connected to electrical component 595. Electrical component 645 may provide the signal (e.g., input signal) to the electronics of electrical component 595 to control a rotation of system 500 and a display of the exemplary disclosed low voltage items. FIG. 9 also illustrates an electrical connection of communication component 635 and audio component 640 to electrical component 595 for providing connection of the exemplary disclosed audio system (e.g., speaker and audio system electronics) to the stand electronics (e.g., included in electrical component 595) to allow audio interface to communication component 635 (e.g., including a Wi-Fi/Bluetooth receiver).

In at least some exemplary embodiments, the exemplary disclosed system and apparatus may include a base assembly (e.g., base assembly 240, base assembly 505, or a portion of assembly 105), a movable assembly (e.g., rotatable assembly 235, base cover assembly 575, or a portion of assembly 105) that is movably supported by the base assembly and that is movable relative to the base assembly, a structural assembly (e.g., member 110, member 210, or a member supported by system 500) that is supported by the movable assembly, a plurality of electrical assemblies supported by the structural assembly, and a first electrical connector (e.g., electrical component 315, electrical component 596, or portion of system 100) that is electrically connectable to some of the plurality of electrical assemblies, the first electrical connector being attached to the movable assembly and including a first plurality of electrical members. The exemplary disclosed system or apparatus may also include a second electrical connector (e.g., electrical component 355 or electrical component 545) that is electrically connectable to a power source, the second electrical connector being attached to the base assembly and including a second plurality of electrical members, and one or more contact members (e.g., conductive member 305, contact 530, or contacts of system 100) that are movably disposed relative to the base assembly, the one or more contact members moving relative to the base assembly when the movable assembly moves relative to the base assembly. The first plurality of electrical members and the second plurality of electrical members may remain electrically connected via the one or more contact members when the one or more contact members moves relative to the base assembly when the movable assembly moves relative to the base assembly. The movable assembly may be rotatably supported by the base assembly and may be rotatable relative to the base assembly. The one or more contact members may be selected from the group consisting of ball bearings and spring-loaded contacts. Each of the first plurality of electrical members and the second plurality of electrical members may have a 3-wire AC configuration including a 2-wire system and a third additional safety wire. The second plurality of electrical members may further include wires that are electrically connected to an actuator that selectively moves the movable assembly relative to the base assembly. The second plurality of electrical members may be electrically connected to an AC/DC, HI/LO adapter, the AC/DC HI/LO adapter selectively controlling a voltage of the second plurality of electrical members based on being controlled by a switch electrically connected to the AC/DC HI/LO adapter. The structural assembly may be an artificial holiday tree and at least some of the plurality of electrical assemblies may be LED lights. The exemplary disclosed system and apparatus may further include a third electrical connector that is electrically connectable to some of the plurality of electrical assemblies, the third electrical connector being a DC socket that is attached to the movable assembly and that includes two DC wires. The exemplary disclosed system and apparatus may further include two DC contact members that are movably disposed relative to the base assembly, the two DC contact members moving relative to the base assembly when the movable assembly moves relative to the base assembly, wherein the two DC wires remain electrically connected via the two DC contact members to the base assembly when the two DC contact members move relative to the base assembly when the movable assembly moves relative to the base assembly. The exemplary disclosed system and apparatus may further include a switch that is electrically connected to the two DC wires via a second plurality of DC wires that are electrically connected to the two DC contact members, wherein the switch is electrically connected to an AC/DC, HI/LO adapter, and wherein the second plurality of electrical members are electrically connected to the AC/DC, HI/LO adapter, the AC/DC HI/LO adapter selectively controlling a voltage of the second plurality of electrical members based on being controlled by the switch.

In at least some exemplary embodiments, the exemplary disclosed system and apparatus may include a base assembly (e.g., base assembly 240) including at least one first elongated recess having a first conductive surface, a rotatable assembly that is rotatably supported by the base assembly and that is rotatable relative to the base assembly, the rotatable assembly (e.g., rotatable assembly 235) including at least one second elongated recess having a second conductive surface that faces the first conductive surface, a structural assembly (e.g., member 210) that is supported by the rotatable assembly, and a plurality of electrical assemblies supported by the structural assembly. The exemplary disclosed system and apparatus may also include a first electrical connector (e.g., electrical component 315) that is electrically connectable to some of the plurality of electrical assemblies, the first electrical connector being attached to the rotatable assembly and including a first plurality of electrical members, a second electrical connector (e.g., electrical component 355) that is electrically connectable to a power source, the second electrical connector being attached to the base assembly and including a second plurality of electrical members, and one or more contact members (e.g., conductive member 305) that are movably disposed in a cavity formed between the first and second conductive surfaces, the one or more contact members movable along the cavity when the movable assembly moves relative to the base assembly. The first plurality of electrical members and the second plurality of electrical members may remain electrically connected via the first and second conductive surfaces and the one or more contact members when the movable assembly moves relative to the base assembly. The one or more contact members may be ball bearings. Each of the first plurality of electrical members and the second plurality of electrical members may have a 3-wire AC configuration including a 2-wire system and a third additional safety wire. The at least one first elongated recess may be a plurality of first elongated recesses and the at least one second elongated recess may be a plurality of second elongated recesses, the plurality of first and second elongated recesses forming a plurality of cavities disposed between the base assembly and the rotatable assembly. A first cavity and a second cavity of the plurality of cavities may be formed between a side portion of the base assembly and a side portion of the rotatable assembly, one or more side contact members disposed in the first and second cavities being in electrical contact with the 2-wire system. A third cavity of the plurality of cavities may be formed between a top portion of the base assembly and a bottom portion of the rotatable assembly, one or more bottom contact members disposed in the third cavity being in electrical contact with the third additional safety wire.

In at least some exemplary embodiments, the exemplary disclosed system and apparatus may include a base assembly (e.g., base assembly 505) including a first elongated protrusion, a second elongated protrusion, and a third elongated protrusion (e.g., portions 515, 520, and 525), a rotatable assembly (e.g., base cover assembly 575) that may be rotatably supported by the base assembly and that may be rotatable relative to the base assembly, the rotatable assembly including a first contact member, a second contact member, and a third contact member (e.g., contacts 530), a structural assembly that may be supported by the rotatable assembly, and a plurality of electrical assemblies supported by the structural assembly. The exemplary disclosed system and apparatus may also include a first electrical connector (e.g., electrical component 596) that may be electrically connectable to some of the plurality of electrical assemblies, the first electrical connector being attached to the rotatable assembly and including a first plurality of electrical members, and a second electrical connector (e.g., electrical component 545) that may be electrically connectable to a power source, the second electrical connector being attached to the base assembly and including a second plurality of electrical members. The first contact member may align with the first elongated protrusion when the rotatable assembly rotates relative to the base assembly, the second contact member may align with the second elongated protrusion when the rotatable assembly rotates relative to the base assembly, and the third contact member may align with the third elongated protrusion when the rotatable assembly rotates relative to the base assembly. The first, second, and third contact members may remain electrically connected, respectively, with the first, second, and third elongated protrusions when the movable assembly moves relative to the base assembly. Each of the first plurality of electrical members and the second plurality of electrical members may have a 3-wire AC configuration including a 2-wire system and a third additional safety wire. Each of the first, second, and third contact members may be spring-loaded contacts. The first, second, and third elongated protrusions may form concentric circles extending about a center portion of the base assembly.

In at least some exemplary embodiments, the exemplary disclosed system, apparatus, and method may include a control assembly (e.g., a mechanical or electromechanical switch) that may separately control electrical elements (e.g., electrical elements 140 such as tree lights) and an assembly (e.g., assembly 105 such as a motorized rotary stand). For example as illustrated in FIGS. 10-16, the exemplary disclosed system, apparatus, and method may separately control artificial tree lights and a rotation of an artificial tree. The exemplary disclosed system, apparatus, and method may separately control (e.g., turn on and off) a motor that rotates an artificial tree and a lighting circuit to separately control rotation and lighting of an exemplary disclosed system. In at least some exemplary embodiments, control assemblies (e.g., switches such as foot switches) may be included on or at an incoming electrical component (e.g., incoming power cable) to separately control (e.g., turn on and off power to) a rotational tree stand motor and an electrical lighting circuit.

Figure 10:
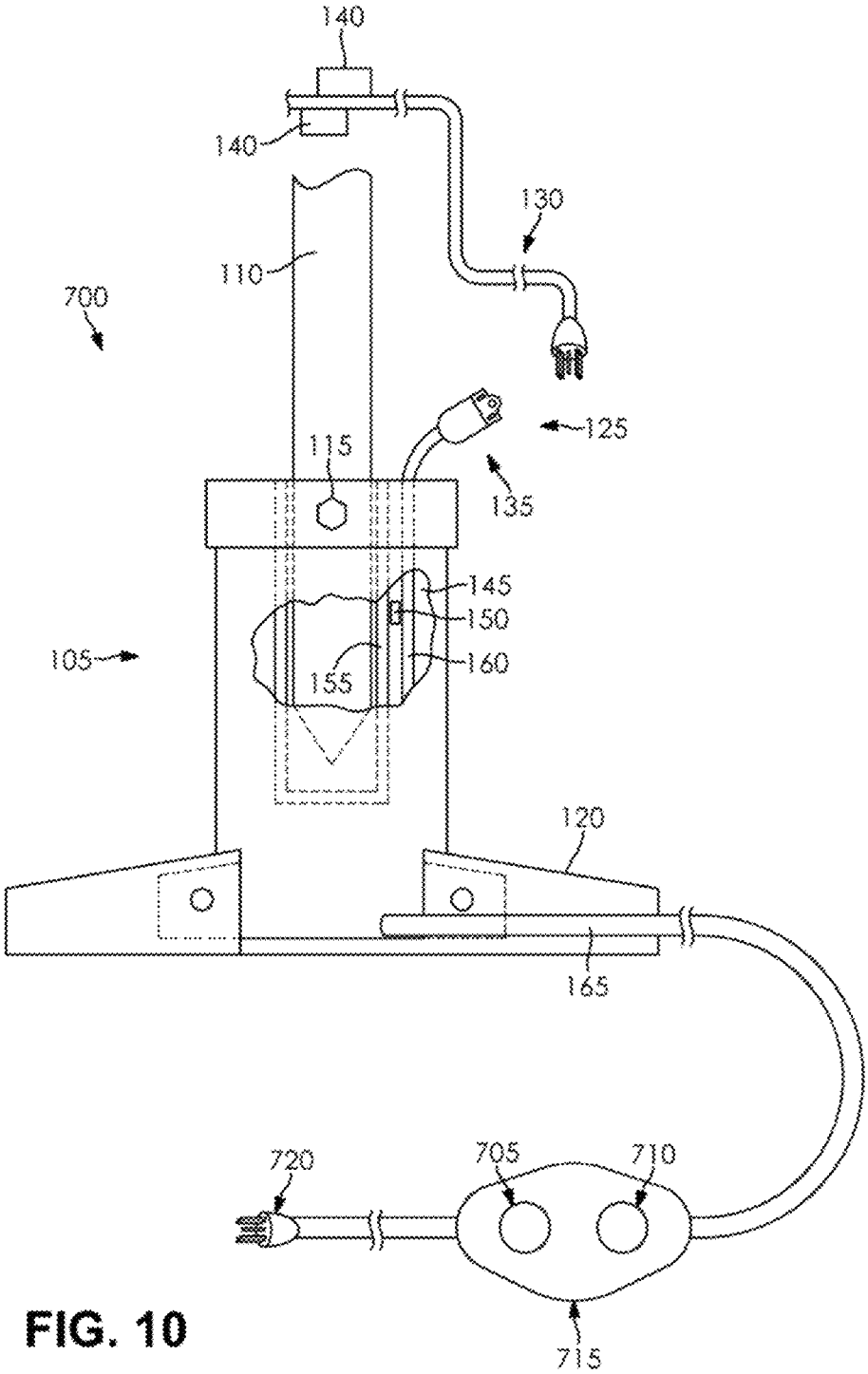
FIG. 10 illustrates a side view of at least some exemplary embodiments of the present disclosure.

FIG. 10 illustrates another exemplary embodiment of the exemplary disclosed system, apparatus, and method. System 700 may be generally similar to system 100. System 700 may include an electrical component 705 (e.g., a switch) and an electrical component 710 (e.g., a switch) that may be disposed on electrical component 165 (e.g., a power cable such as a 3-wire power lead). Electrical components 705 and 710 may be any suitable mechanical, electromechanical, electrical, or electronic switch for an electrical circuit such as a button switch (e.g., push button switch), a pole throw switch (e.g., single/double pole single/double throw switch), a rotary switch, a toggle switch, a transistor switch, a MOSFET switch, a diode switch, or any other suitable switch for an electrical circuit. Electrical components 705 and 710 may be separate switches or portions of a single integrated switch. In at least some exemplary embodiments, electrical component 705 may be a switch (e.g., tree lighting switch) for controlling electrical elements such as electrical elements 140 (e.g., lights such as Christmas tree lights) and electrical component 710 may be a switch (e.g., motor switch) for controlling an assembly (e.g., assembly 105 or assembly 205, such as a motorized rotary stand).

Electrical components 705 and 710 may be disposed in (e.g., partially or substantially entirely disposed in) a housing 715. Housing 715 may be switch housing such as a foot switch housing. Housing 715 and/or other structural components of system 700 (e.g., and/or systems 100, 200, and/or 500) may be formed from any suitable material such as, for example, plastic, metal, composite material, wood, or any other suitable structural material. Housing 715 may be disposed on or at electrical component 165 at a position between assembly 105 and an electrical component 720 that may be an electrical plug that is similar to electrical component 130.

In at least some exemplary embodiments, housing 715 may be a foot pedal switch housing that contains electrical components 705 and 710 that may be push button switches. Electrical component 705 may be a switch that controls power (e.g., turns power on and off) to electrical components 165 and 720 that form a 3-wire socket that powers electrical elements 140 (e.g., powers grounded tree light strings and/or electrical decorations). Electrical component 710 may be a switch that controls power to assembly 105 (e.g., or assembly 205) that may be motorized tree stand including a rotation motor (e.g., and electrical components 165 and 720).

Figure 11:
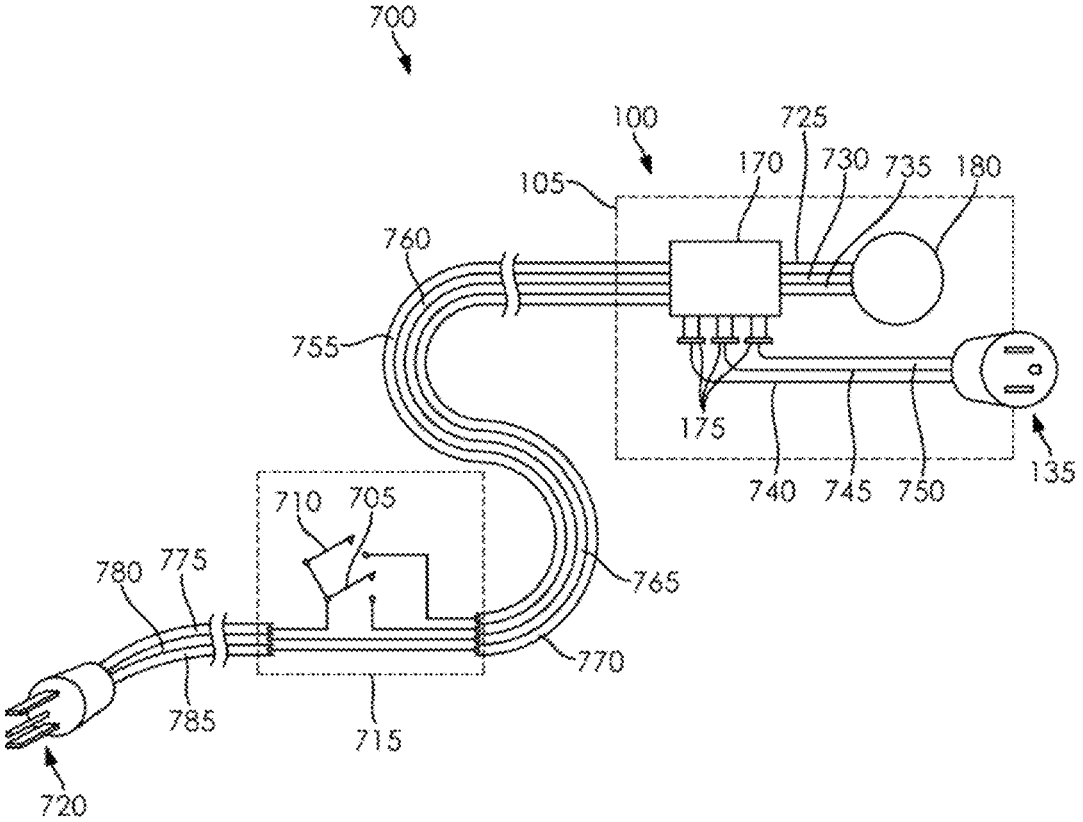
FIG. 11 illustrates a schematic view of at least some exemplary embodiments of the present disclosure.

As illustrated in FIG. 11, system 700 may include a plurality of leads (e.g., a rotary power lead 725, a third wire safety lead 730, and a neutral lead 735) that may connect contactor 170 and actuator 180 that may drive a rotation of member 110 (e.g., may rotate a structure such as an artificial tree). System 700 may also include a plurality of leads (e.g., a lighting power lead 740, a third wire safety lead 745, and a neutral lead 750) that may connect contactor 170 and electrical component 135 that may power electrical elements 140 (e.g., tree lights) based on electrical component 135 being connected to electrical component 130. System 700 may further include a plurality of leads (e.g., a rotary power lead 755, a lighting power lead 760, a third wire safety lead 765, and a neutral lead 770) that may connect contactor 170 and electrical components 705 and 710 disposed in housing 715. System 700 may further include a plurality of leads (e.g., a power lead 775, a third wire ground 780, and a neutral lead 785) that may connect electrical components 705 and 710 disposed in housing 715 and electrical component 720.

Based on a position of electrical components 705 and 710 in housing 715 (e.g., based on a switch position), system 700 may power actuator 180 (e.g., to rotate a structure such as an artificial tree) or electrical elements 140. For example, electrical component 710 may be selectively positioned to electrically connect power lead 775 to rotary power lead 755 (e.g., that may be electrically connected to rotary power lead 725) to power actuator 180 (e.g., to rotate a structure such as an artificial tree). Also for example, electrical component 705 may be selectively positioned to electrically connect power lead 775 to lighting power lead 760 (e.g., that may be electrically connected to lighting power lead 740) to power electrical elements 140 (e.g., to power tree lights) via a connection of electrical component 135 to electrical component 130. A user may control the position of electrical components 705 and 710 based on any suitable manipulation or interface (e.g., based on pushing electrical components 705 and 710 that may be push-button switches disposed on housing 715 that may be a foot pedal switch housing).

Figure 12:
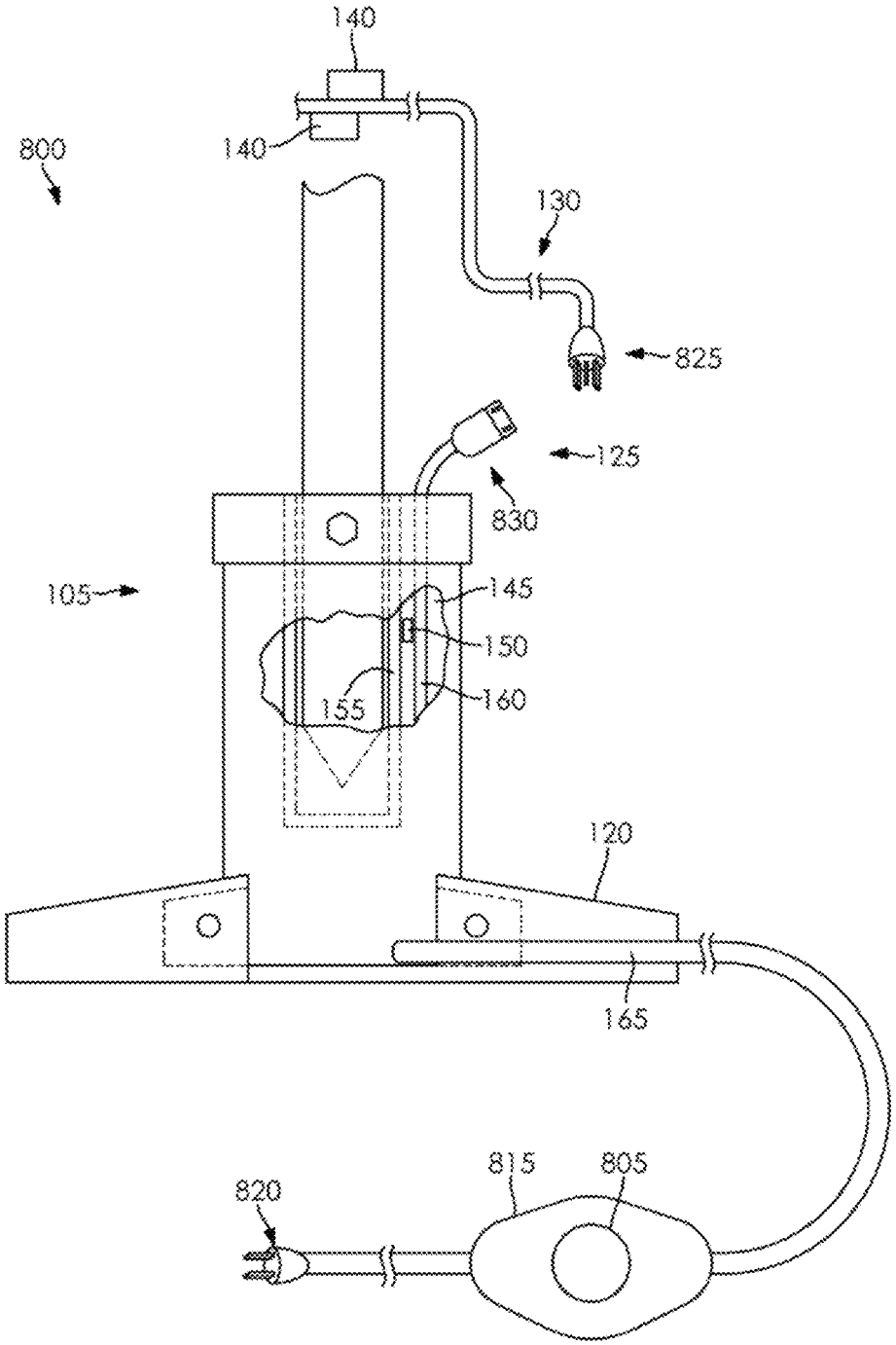
FIG. 12 illustrates a side view of at least some exemplary embodiments of the present disclosure.

FIG. 12 illustrates another exemplary embodiment of the exemplary disclosed system, apparatus, and method. System 800 may be generally similar to system 700. System 800 may include an electrical component 805 (e.g., a switch) that may be disposed on electrical component 165 (e.g., a power cable such as a 3-wire power lead). Electrical component 805 may be generally similar to electrical components 705 and 710. In at least some exemplary embodiments, electrical component 805 may be a push-button switch. Electrical component 805 may be a switch for controlling electrical elements such as electrical elements 140 (e.g., lights such as Christmas tree lights) and an assembly (e.g., assembly 105 or assembly 205, such as a motorized rotary stand).

Electrical component 805 may be disposed in (e.g., partially or substantially entirely disposed in) a housing 815 that may be generally similar to housing 715. In at least some exemplary embodiments, housing 815 may be a foot pedal housing. Housing 815 may be disposed on or at electrical component 165 at a position between assembly 105 and an electrical component 820 that may be a polarized electrical component. For example, electrical component 820 may be a polarized electrical plug such as a 2-wire power cord with a polarized plug. In at least some exemplary embodiments, electrical component 820 may include two substantially flat prongs of different sizes.

System 800 may also include electrical components 825 and 830 that may be polarized electrical components. For example, electrical component 825 may be a polarized electrical plug that may be similar to electrical component 820. Electrical component 830 may be a polarized electrical socket (e.g., a 2-wire polarized socket) that may be removably attached to electrical component 825 to power electrical elements 140 (e.g., powers grounded tree light strings and/or electrical decorations).

Figure 13:
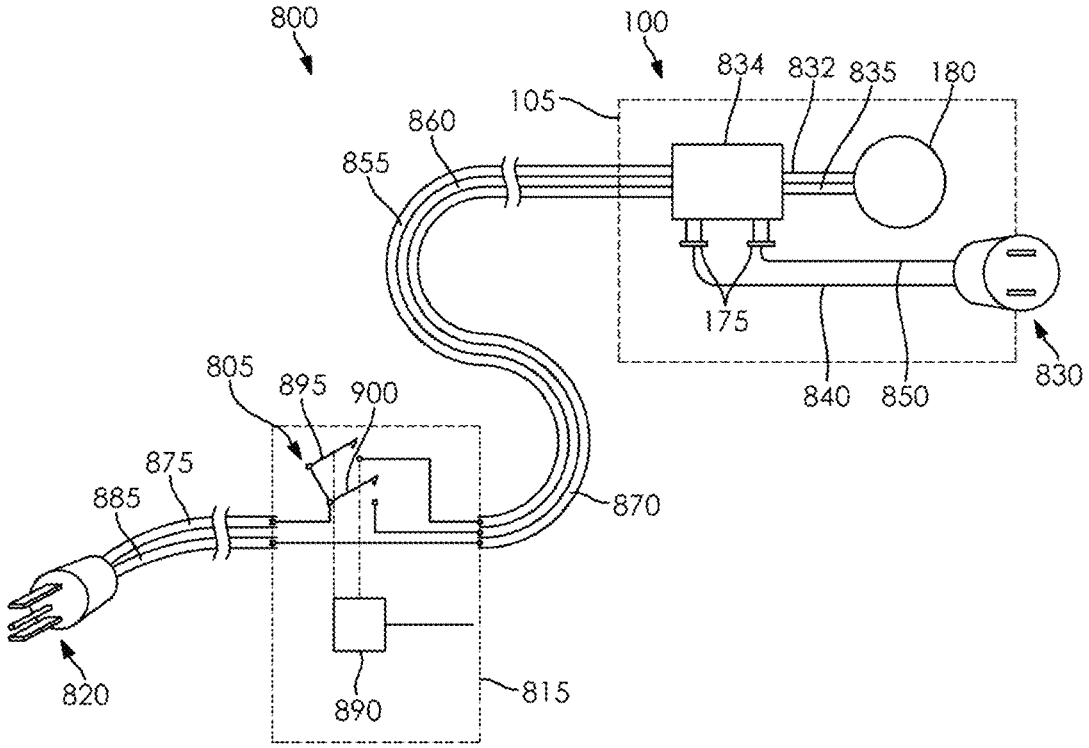
FIG. 13 illustrates a schematic view of at least some exemplary embodiments of the present disclosure.

As illustrated in FIG. 13, system 800 may include a plurality of leads (e.g., a rotary power lead 832 and a neutral lead 835) that may connect a contactor 834 (e.g., that may be generally similar to contactor 170) and actuator 180 that may drive a rotation of member 110 (e.g., may rotate a structure such as an artificial tree). System 800 may also include a plurality of leads (e.g., a lighting power lead 840 and a neutral lead 850) that may connect contactor 834 and electrical component 830 that may power electrical elements 140 (e.g., tree lights) based on electrical component 830 being connected to electrical component 825. System 800 may further include a plurality of leads (e.g., a rotary power lead 855, a lighting power lead 860, and a neutral lead 870) that may connect contactor 834 and electrical component 805 disposed in housing 815. System 800 may further include a plurality of leads (e.g., a power lead 875 and a neutral lead 885) that may connect electrical component 805 disposed in housing 815 and electrical component 820.

Electrical component 805 may include a device 890 that may control a switching of electrical component between the exemplary disclosed leads. For example, device 890 may be a stepping switch mechanism. Electrical component 805 may also include a switch component 895 that may be a rotary motor switch and a switch component 900 that may be a lighting switch. Device 890 may control a position of switch component 895 and switch component 900 (e.g., based on a user actuating electrical component 805 that may be a foot pedal push button). Based on a position of switch components 895 and 900 in housing 815, system 800 may power actuator 180 (e.g., to rotate a structure such as an artificial tree) or electrical elements 140. For example, switch component 895 may be selectively positioned to electrically connect power lead 875 to rotary power lead 855 (e.g., that may be electrically connected to rotary power lead 832) to power actuator 180 (e.g., to rotate a structure such as an artificial tree). Also for example, switch component 900 may be selectively positioned to electrically connect power lead 875 to lighting power lead 860 (e.g., that may be electrically connected to lighting power lead 840) to power electrical elements 140 (e.g., to power tree lights) via a connection of electrical component 830 to electrical component 825. A user may control the position of switch components 895 and 900 based on any suitable manipulation or interface (e.g., based on pushing electrical component 805 that may be a push-button switch disposed on housing 815 that may be a foot pedal switch housing). In at least some exemplary embodiments, electrical component 805 may include a rotating stepper mechanism (e.g., a stepper function internal rotating mechanism) such as device 890 via which successive actuation (e.g., depressions) of electrical component 805 (e.g., a push-button) may cause switch components 895 and 900 to close and open in sequence to control components of system 800 for example as described below. For example, a user may make actuations (e.g., actuate or press electrical component 805 that may be a button such as a foot pedal push-button) as described below to control components of system 800.

Figure 14:
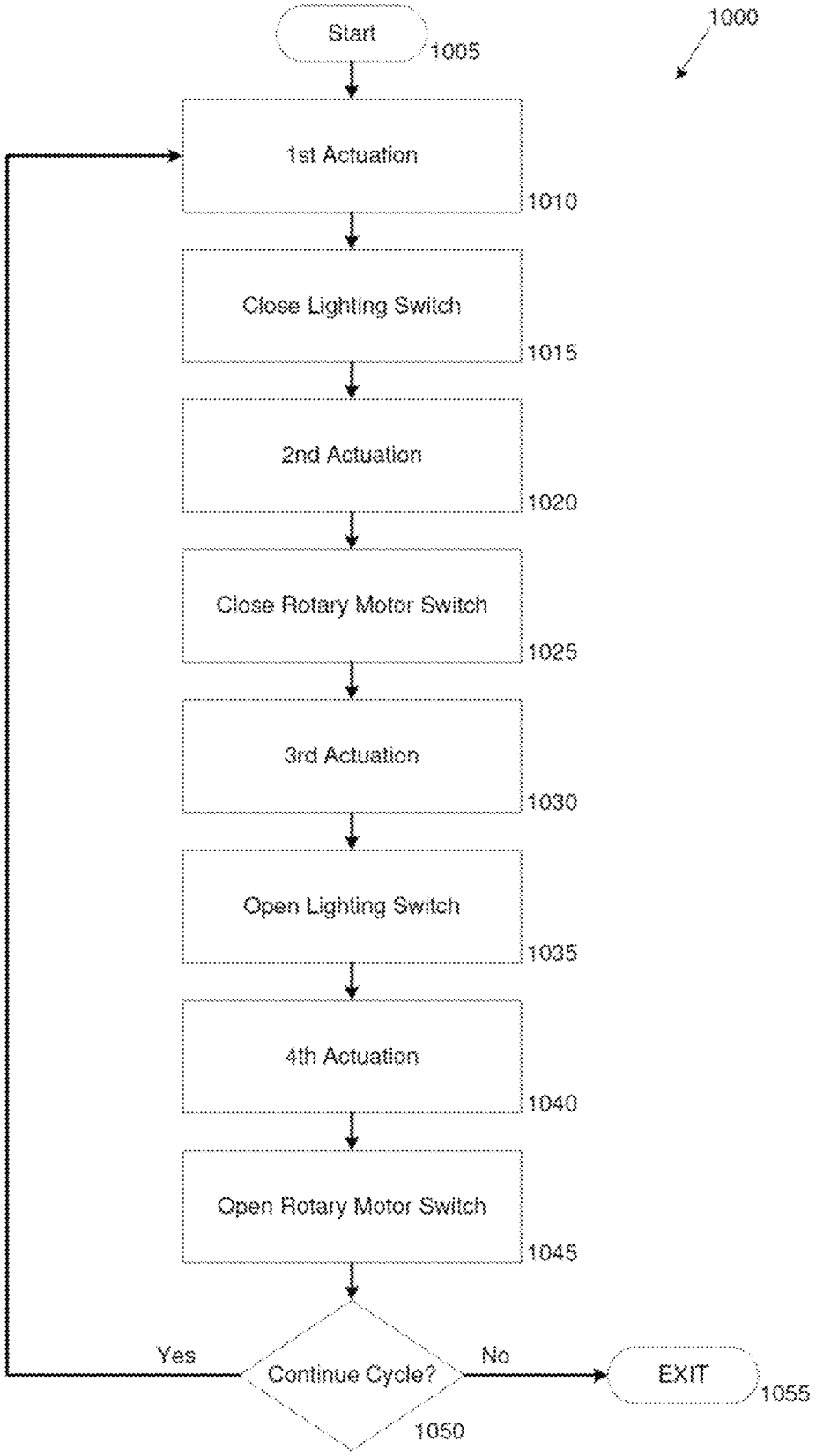
FIG. 14 illustrates an exemplary process of at least some exemplary embodiments of the present disclosure.

FIG. 14 illustrates an exemplary operation of system 800. Process 1000 begins at step 1005. For example at step 1005, switch components 895 and 900 of electrical component 805 may both be open so that electrical current (e.g., power) is not transferred to actuator 180 or electrical elements 140 as described above.

At step 1010, a user may make a first actuation of electrical component 805 (e.g., which may actuate device 890 to open and close circuits as described for example herein). Based on the first actuation at step 1010, switch component 900 may close at step 1015 so that electrical current (e.g., power) is transferred to electrical elements 140 (e.g., to power tree lighting) as described above. Switch component 895 may remain open as step 1015 to that power is not transferred to actuator 180. Alternatively for example at step 1015, electrical current (e.g., power) may be transferred to actuator 180 and not transferred to electrical elements 140.

At step 1020, the user may make a second actuation of electrical component 805. Based on the second actuation at step 1020, switch component 895 may close at step 1025 so that electrical current (e.g., power) is transferred to actuator 180 as described above. Switch component 900 may remain closed at step 1025. Accordingly for example at step 1025, power may be transferred to both electrical elements 140 (e.g., to power tree lighting) and actuator 180 (e.g., to rotate an artificial tree).

At step 1030, the user may make a third actuation of electrical component 805. Based on the third actuation at step 1030, switch component 900 may open at step 1035 so that electrical current (e.g., power) is no longer transferred to electrical elements 140. Switch component 895 may remain closed at step 1035 so that power may be transferred to actuator 180 (e.g., to rotate an artificial tree). Alternatively for example at step 1035, electrical current (e.g., power) may be transferred to electrical elements 140 and not transferred to actuator 180.

At step 1040, the user may make a fourth actuation of electrical component 805. Based on the fourth actuation at step 1040, switch component 895 may open at step 1045 so that electrical current (e.g., power) is no longer transferred to actuator 180. Switch component 900 may also remain open at step 1045 so that electrical current (e.g., power) is not transferred to electrical elements 140.

At step 1050, a user may decide whether to repeat the exemplary process. If the user desires to repeat the cycle, the user may make another (e.g., a fifth) actuation of electrical component 805, which may return system 800 to step 1010. The fifth actuation may serve as a first actuation at step 1010 and the process may continue as described above. Alternatively for example in at least some exemplary embodiments, the user may make an additional actuation to serve as the first actuation at step 1010 to continue process 1000.

If the user does not wish to repeat the cycle at step 1050, process 1000 may end at step 1055. For example, system 800 may cease operating after a predetermined time period (e.g., after a predetermined period of time such as twenty minutes elapses without electrical component 805 being actuated at step 1050).

Figure 15:
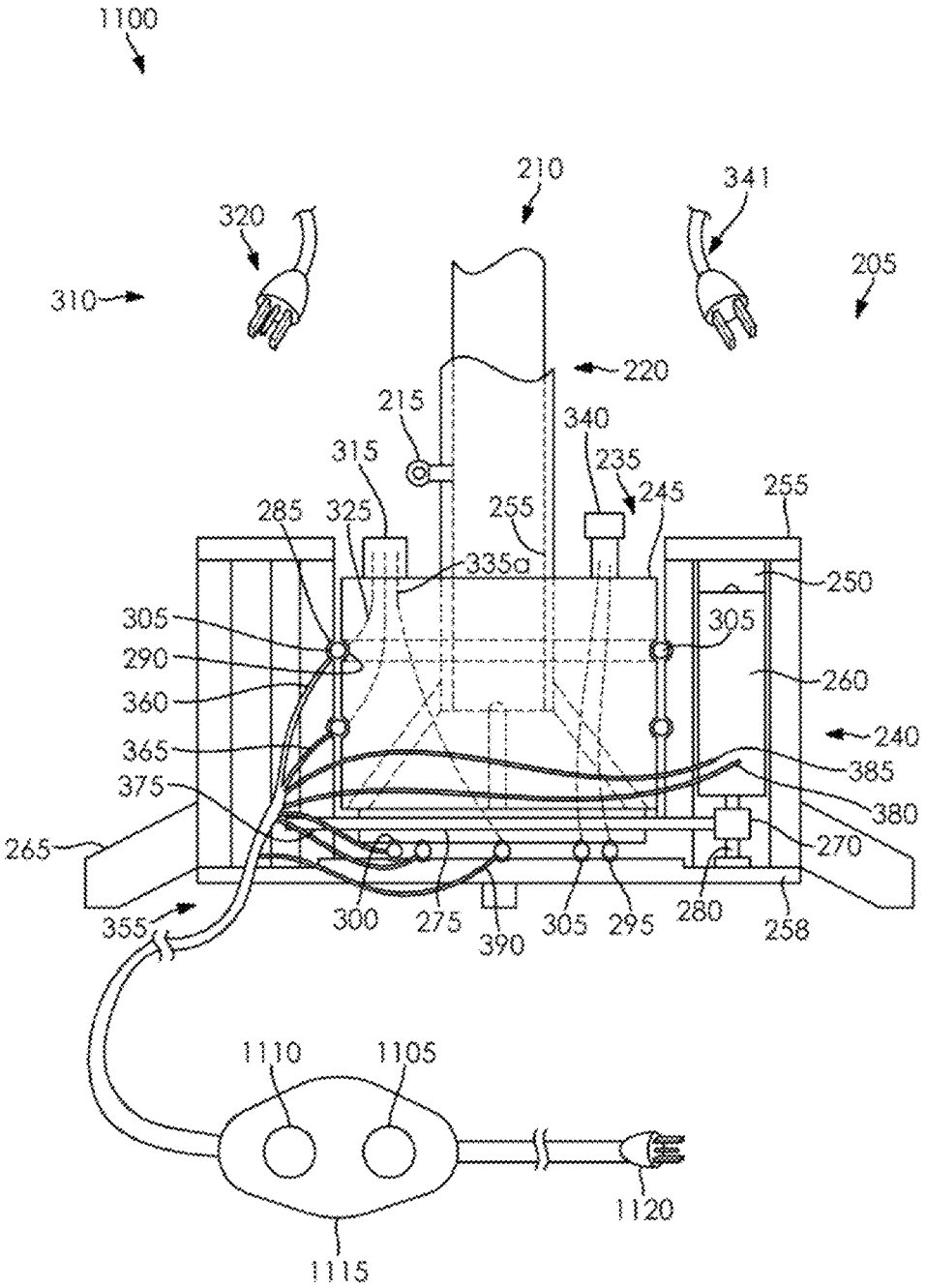
FIG. 15 illustrates a side view of at least some exemplary embodiments of the present disclosure.

FIG. 15 illustrates another exemplary embodiment of the exemplary disclosed system, apparatus, and method. System 1100 may be generally similar to system 200. System 1100 may include an electrical component 1105 (e.g., a switch) and an electrical component 1110 that may be disposed on electrical component 355 (e.g., a power cable such as a 3-wire power lead). Electrical components 1105 and 1110 may be generally similar to electrical components 705 and 710. In at least some exemplary embodiments, electrical components 1105 and 1110 may be push-button switches. Electrical components 1105 and 1110 may be switches for controlling electrical elements such as electrical elements 140 (e.g., lights such as Christmas tree lights) and an assembly (e.g., assembly 105 or assembly 205, such as a motorized rotary stand). In at least some exemplary embodiments, electrical component 1105 may be a switch (e.g., tree lighting switch) for controlling electrical elements such as electrical elements 140 (e.g., lights such as Christmas tree lights) and electrical component 1110 may be a switch (e.g., motor switch) for controlling an assembly (e.g., assembly 105 or assembly 205, such as a motorized rotary stand for example via powering actuator 260).

Electrical components 1105 and 1110 may be disposed in (e.g., partially or substantially entirely disposed in) a housing 1115 that may be generally similar to housing 715. In at least some exemplary embodiments, housing 1115 may be a foot pedal housing. Housing 1115 may be disposed on or at electrical component 355 at a position between assembly 205 and an electrical component 1120 that may be an electrical plug that may be similar to electrical component 130.

Figure 16:
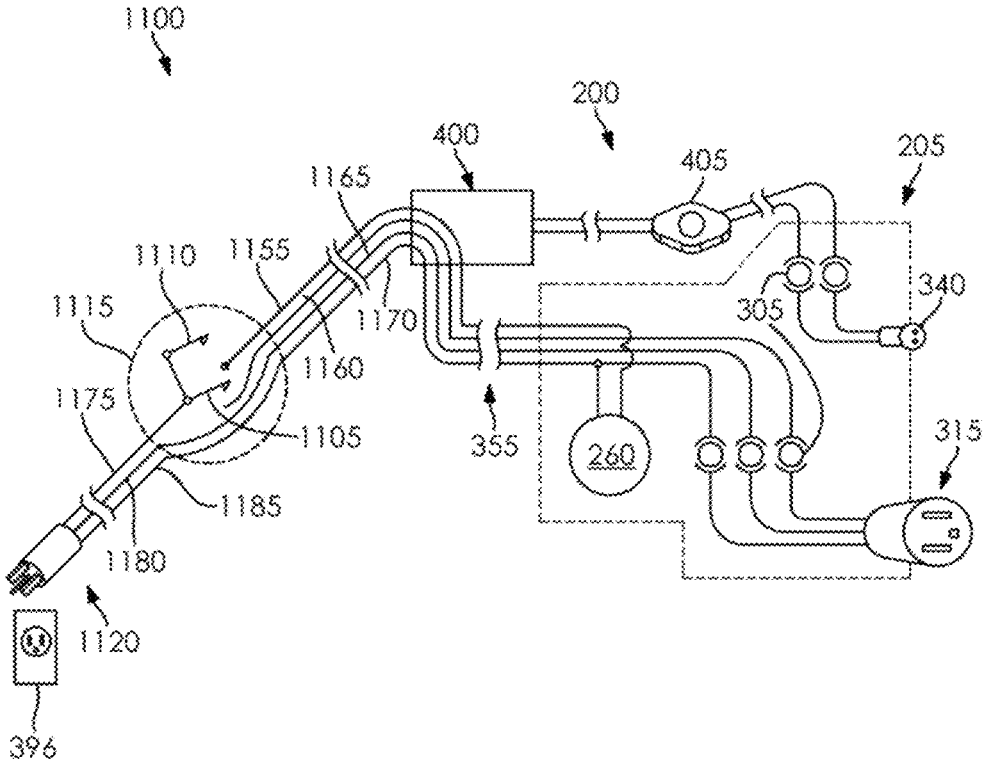
FIG. 16 illustrates a schematic view of at least some exemplary embodiments of the present disclosure.

As illustrated in FIG. 16, system 1100 may include a plurality of leads (e.g., a rotary power lead 1155, a lighting power lead 1160, a third wire safety lead 1165, and a neutral lead 1170) that may connect electrical component 400 and electrical components 1105 and 1110 disposed in housing 1115. System 1100 may further include a plurality of leads (e.g., a power lead 1175, a third wire ground 1180, and a neutral lead 1185) that may connect electrical components 1105 and 1110 disposed in housing 1115 and electrical component 1120.

Based on a position of electrical components 1105 and 1110 in housing 1115 (e.g., based on a switch position), system 1100 may power actuator 260 (e.g., to rotate a structure such as an artificial tree) or electrical elements 140 via electrical component 315. For example, electrical component 1110 may be selectively positioned to electrically connect power lead 1175 to rotary power lead 1155 to power actuator 260 (e.g., to rotate a structure such as an artificial tree). Also for example, electrical component 1105 may be selectively positioned to electrically connect power lead 1175 to lighting power lead 1160 to power electrical elements 140 (e.g., to power tree lights) via electrical component 315. A user may control the position of electrical components 1105 and 1110 based on any suitable manipulation or interface (e.g., based on pushing electrical components 1105 and 1110 that may be push-button switches disposed on housing 1115 that may be a foot pedal switch housing). In at least some exemplary embodiments, electrical component 355 may be an incoming 3-wire safety AC cable and safety grounded plug and cable that connects to electrical components 1105 and 1110 disposed in housing 1115. Electrical component 1105 may control power transfer (e.g., electrical current flow via lighting power lead 1160) to electrical component 315 that may be a tree lighting socket and electrical component 1110 may control actuator 260 via rotary power lead 1155.

In at least some exemplary embodiments, the exemplary disclosed apparatus may include a base assembly (e.g., base assembly 240, base assembly 505, or a portion of assembly 105), a movable assembly (e.g., rotatable assembly 235, base cover assembly 575, or a portion of assembly 105) that is movably supported by the base assembly, a structural assembly (e.g., member 110, member 210, or a member supported by system 500) that is supported by the movable assembly, and a plurality of electrical assemblies that are supported by the structural assembly. The exemplary disclosed apparatus may also include an actuating assembly configured to move the movable assembly relative to the base assembly, a first electrical connector (e.g., electrical component 315, electrical component 596, or portion of system 100) that is electrically connectable to the actuating assembly and the plurality of electrical assemblies, a second electrical connector (e.g., electrical component 355, electrical component 545, or electrical component 165) that is electrically connectable to a power source, and a switch assembly disposed on the second electrical connector. The first and second electrical connectors may be electrically connected via one or more contact members that are movably disposed relative to the base assembly. The switch assembly may be configured to selectively electrically connect the power source to at least one of the actuating assembly and the plurality of electrical assemblies via the first and second electrical connectors. The switch assembly may be configured to electrically connect the power source to the actuating assembly while blocking an electrical connection between the power source and the plurality of electrical assemblies. The switch assembly may be configured to electrically connect the power source to the plurality of electrical assemblies while blocking an electrical connection between the power source and the actuating assembly. The switch assembly may be configured to electrically connect the power source to both the actuating assembly and the plurality of electrical assemblies. The switch assembly may be configured to block an electrical connection between the power source and both the actuating assembly and the plurality of electrical assemblies. The structural assembly may be an artificial holiday tree and the plurality of electrical assemblies is a plurality of LED lights. The switch assembly may include a foot pedal switch housing that contains at least one push button switch. The first and second electrical connectors may be selected from the group consisting of a 3-wire safety AC cable and safety-grounded plug and a 2-wire power cord with a polarized plug or socket. The actuating assembly may be a motor and the movable assembly may be rotatably supported by the base assembly and is rotatable relative to the base assembly. The second electrical connector may be an electrical power cord that is attached to the base assembly. The first electrical connector may include a first plurality of electrical members, the second electrical connector may include a second plurality of electrical members, the one or more contact members may move relative to the base assembly when the movable assembly moves relative to the base assembly, and the first plurality of electrical members and the second plurality of electrical members may remain electrically connected via the one or more contact members when the one or more contact members moves relative to the base assembly when the movable assembly moves relative to the base assembly. The one or more contact members may be selected from the group consisting of ball bearings and spring-loaded contacts.

In at least some exemplary embodiments, the exemplary disclosed method may include providing a base assembly (e.g., base assembly 240, base assembly 505, or a portion of assembly 105), movably supporting a movable assembly (e.g., rotatable assembly 235, base cover assembly 575, or a portion of assembly 105) with the base assembly, supporting a structural assembly (e.g., member 110, member 210, or a member supported by system 500) with the movable assembly, supporting a plurality of electrical assemblies with the structural assembly, moving the movable assembly relative to the base assembly using an actuating assembly, electrically connecting a first electrical connector (e.g., electrical component 315, electrical component 596, or portion of system 100) to the actuating assembly and the plurality of electrical assemblies, electrically connecting a second electrical connector (e.g., electrical component 355, electrical component 545, or electrical component 165) to a power source, disposing a switch assembly on the second electrical connector, electrically connecting the first and second electrical connectors via one or more contact members that are movably disposed relative to the base assembly, and selectively electrically connecting the power source using the switch assembly to at least one of the actuating assembly and the plurality of electrical assemblies via the first and second electrical connectors. Using the switch assembly may include actuating the switch assembly with a first actuation that electrically connects the power source to one of the plurality of electrical assemblies and the actuating assembly while blocking an electrical connection between the power source and the other of the plurality of electrical assemblies and the actuating assembly. Using the switch assembly may further include actuating the switch assembly with a second actuation that electrically connects the power source to both the actuating assembly and the plurality of electrical assemblies. Using the switch assembly may include actuating the switch assembly with a third actuation that electrically connects the power source to one of the plurality of electrical assemblies and the actuating assembly while blocking an electrical connection between the power source and the other of the plurality of electrical assemblies and the actuating assembly. Using the switch assembly may include actuating the switch assembly with a fourth actuation that blocks an electrical connection between the power source and both the actuating assembly and the plurality of electrical assemblies.

In at least some exemplary embodiments, the exemplary disclosed apparatus may include a base assembly (e.g., base assembly 240, base assembly 505, or a portion of assembly 105), a rotatable assembly (e.g., rotatable assembly 235, base cover assembly 575, or a portion of assembly 105) that is rotatably supported by the base assembly, an artificial tree (e.g., member 110, member 210, or a member supported by system 500) that is supported by the rotatable assembly, a plurality of LED tree lights that are supported by the artificial tree, a motor configured to rotate the rotatable assembly relative to the base assembly, a first electrical connector (e.g., electrical component 315, electrical component 596, or portion of system 100) that is electrically connectable to the motor and the plurality of LED tree lights, a second electrical connector (e.g., electrical component 355, electrical component 545, or electrical component 165) that is electrically connectable to a power source, and a foot pedal switch housing, which includes at least one push button switch, disposed on the second electrical connector. The first and second electrical connectors may be electrically connected via one or more contact members that are movably disposed relative to the base assembly. The at least one push button switch may be configured to selectively electrically connect the power source to at least one of the motor and the plurality of LED tree lights via the first and second electrical connectors. The at least one push button switch may be configured to electrically connect the power source to the motor while blocking an electrical connection between the power source and the plurality of LED tree lights. The at least one push button switch may be configured to electrically connect the power source to the LED tree lights while blocking an electrical connection between the power source and the motor.

Figure 17:
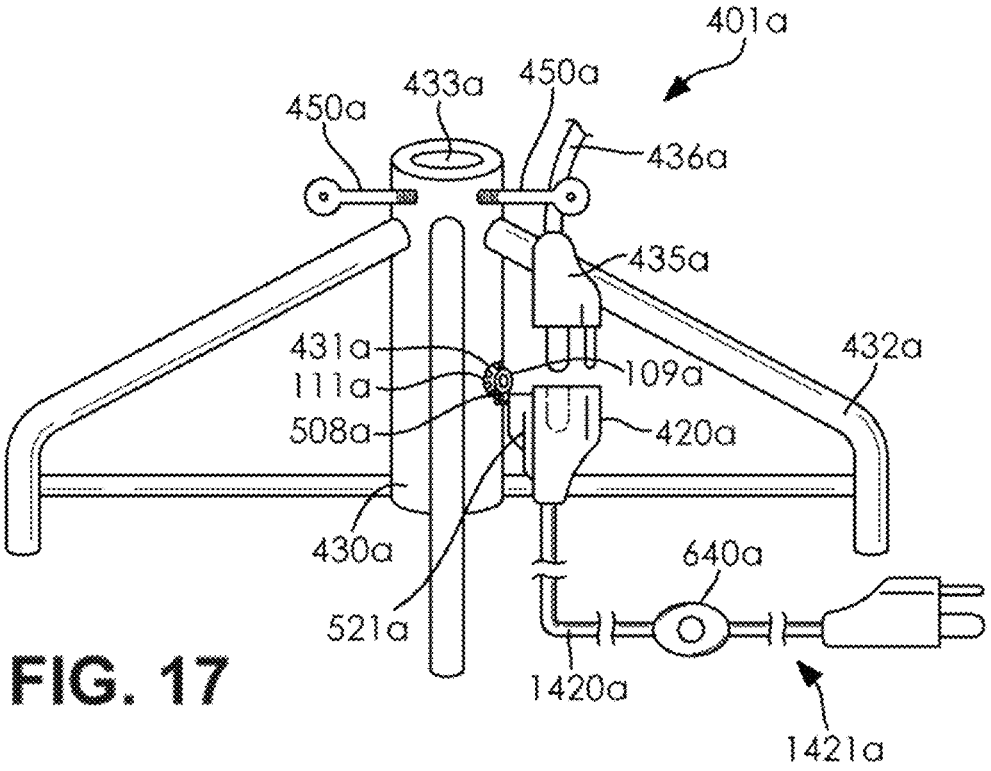
FIG. 17 shows a partially exploded view of another exemplary safety system, according to some embodiments of the present invention.

FIG. 17 illustrates an electrical assembly 401*a*. Electrical assembly 401*a* may be an electrical assembly for grounding a tree stand. Electrical assembly 401*a* may include an electrical component 420*a* (e.g., a power cord) attached to a bare metal ground point portion 431*a* on a base section 430*a* (e.g., a conductive base section) of a decorative assembly such as a lighted Christmas tree by a fastener 109*a* and a fastener component 111*a*. Fastener 109*a* may be for example a tamper-proof screw. Fastener component 111*a* may be for example a star washer. Base section 430*a* may be for example a stand assembly such as a metal artificial tree stand assembly. Base section 430*a* may be attached to and supported by a plurality of structural members 432*a*. For example, base section 430*a* may include a cavity 433*a* (e.g., a receptacle) for receiving a structural member such as a decorative assembly pole (e.g., an artificial tree pole such as a Christmas tree pole) for example as described below. Base section 430*a* may be supported by the plurality of structural members 432*a* that may be legs of a tree stand.

Electrical component 420*a* may be attached to base section 430*a*. Electrical component 420*a* may be for example an electrical socket (e.g., including a female end) of a power cord. In at least some exemplary embodiments, electrical component 420*a* may be a three-prong safety grounded socket. For example, a ground prong 508*a* of electrical component 420*a* may be attached to base section 430*a* by any suitable technique. For example, welding, soldering, and/or any suitable attachment device such as a screw-down terminal may be used to attach and electrically connect ground prong 508*a* to base section 430*a*. Ground prong 508*a* may allow electrical component 420*a* (e.g., including a female end) to be secured to base section 430*a* while simultaneously making a ground connection to base section 430*a* (e.g., a ground connection between electrical component 420*a* and base section 430*a*). Ground prong 508*a* may be of any suitable shape and may be attached by any suitable technique to base section 430*a*. Electrical component 420*a* may include a molded base 521*a* that may be configured (e.g., shaped) to match a surface of base section 430*a*. For example, molded base 521*a* may be curved to fit base section 430*a* that may be rounded. Ground prong 508*a* may be attached to, supported by, and/or partially or entirely disposed within molded base 521*a*.

FIG. 17 also illustrates an electrical component 640*a* that may be electrically connected to electrical component 420*a* via an electrical line 1420*a*. Electrical component 640*a*, electrical component 420*a*, and electrical line 1420*a* may be components of an electrical power cord 1421*a*. Electrical component 640*a* may be an electrical switch such as a foot switch that may be connected in line with electrical power cord 1421*a*. Electrical power cord 1421*a* may be electrically connected to an external power source (e.g., an electrical outlet or any other suitable power source). Electrical component 640*a* may include a housing that holds a push-button toggle switch that may control power to a decorative assembly such as a decorative lighted Christmas tree (e.g., similar to as described herein).

An electrical component 435*a* may be selectively plugged into electrical component 420*a*. Electrical component 435*a* may be electrically connected to other electrical elements via a power cord 436*a* as described further below. For example, electrical component 435*a* may be a three-prong safety grounded plug that may be plugged into electrical component 420*a* that may be a three-prong safety grounded socket. Electrical component 435*a* (e.g., or electrical component 420*a* or any other exemplary disclosed plug or socket described herein) may include a fuse. Power may be distributed within an artificial tree (e.g., a decorative lighted Christmas tree such as for example described herein) to various sockets, connectors, and/or light strings via the electrical connection between electrical component 420*a* and electrical component 435*a*. Electrical component 640*a* may allow a user to control the exemplary disclosed devices (e.g., lights) of the exemplary disclosed decorative assembly for example as described below. Alternatively in at least some exemplary embodiments, control of the lighting of the decorative assembly may be controlled by one or more control elements, such as a switch, a selector knob, an indicator panel, or any other suitable human interface device (HID) or any combination thereof. In at least some exemplary embodiments, electrical component 640*a* may include electronics that convert high voltage AC to low voltage DC and pass a ground connection through to electrical component 420*a* that may be a modified female socket to allow for suitable grounding (e.g., even when high voltage AC is not used to power lights and other desired devices on the exemplary disclosed decorative lighted Christmas tree for example as described herein).

In at least some exemplary embodiments, electrical component 420*a* may include a female socket that has a third receptacle for receiving a ground prong (e.g., a ground prong of electrical component 435*a*). Electrical component 420*a* may thereby receive electrical component 435*a* that may be a three-prong grounded male plug. Alternatively for example, electrical component 420*a* may include a female socket that may be polarized (e.g., and electrical component 435*a* may be a two-prong polarized plug, a two-prong non-polarized plug, or a three-prong grounded plug).

As illustrated in FIG. 17, electrical assembly 401*a* may also include a plurality of fasteners 450*a*. Fasteners 450*a* may be securing bolts or securing screws that secure an artificial tree pole as described for example herein into base section 430*a* that may be an artificial tree metal stand. As described for example further below, fasteners 450*a* may be threaded into base section 430*a*. Fasteners 450*a* may be formed from conductive material such as metal material. As described for example further below, fasteners 450*a* may include an abrasive end portion that may cut into and through coatings of base section 430*a* such as paint. Fasteners 450*a* may be electrically conductive (e.g., metal) fasteners that directly contact conductive material of base section 430*a* (e.g., as fasteners 450*a* may bore or cut through paint and other coatings of base section 430*a*), thereby providing for conductive contact (e.g., metal-to-metal contact or other suitable contact between conductive materials) between an artificial tree pole (e.g., as described for example herein) and base section 430*a* (e.g., a grounded tree stand). In at least some exemplary embodiments, electrical component 435*a* may be attached to fastener 450*a* or any other suitable component of electrical assembly 401*a*.

Figure 18:
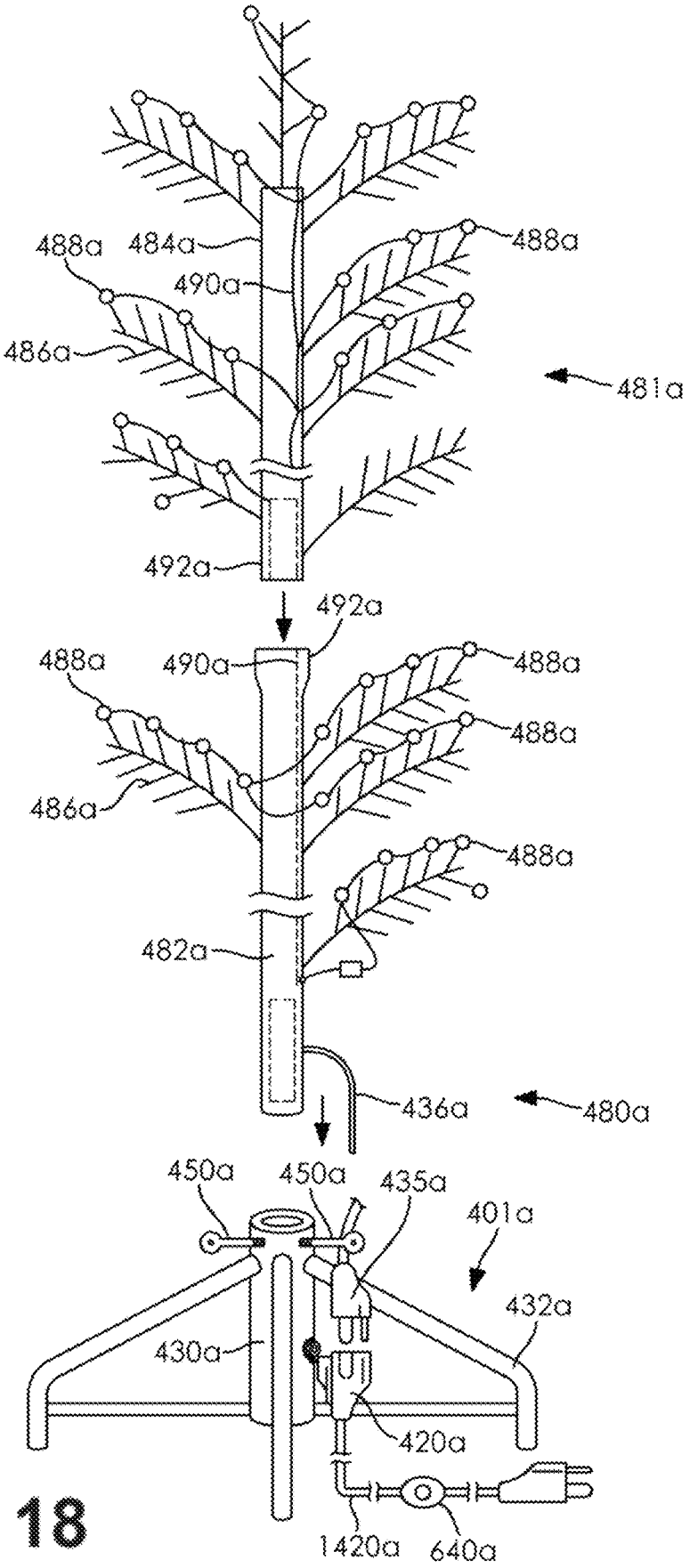
FIG. 18 shows a partially exploded view of the exemplary safety system, according to some embodiments of the present invention.

FIG. 18 illustrates an exemplary decorative system 480*a* that may include a decorative assembly 481*a* that may be selectively attached to base section 430*a* and grounded via electrical assembly 401*a*. Decorative assembly 481*a* may include a plurality of main structural members 482*a* and 484*a*. Decorative assembly 481*a* may be an artificial Christmas tree or any other desired decoration or holiday display. Main structural members 482*a* and 484*a* may be poles such as, for example, artificial Christmas tree poles or any other desired main structural member for a decorative assembly. Main structural members 482*a* and 484*a* may be removably attachable to each other. Main structural members 482*a* and 484*a* may include a plurality of structural members 486*a*. Structural members 486*a* may be supported by main structural members 482*a* or 484*a* and may be tree branches or any other desired structural member for a decorative assembly. Electrical elements 488*a* may be any desired electrical devices such as lighting devices (e.g., electrical devices such as LEDs, LED light strings, and/or incandescent lights or light strings). Electrical elements such as lighting devices may also be integrated into main structural members 482*a* and 484*a* and/or structural members 486*a*. One or more electrical wires 490*a* may be disposed partially or substantially completely within and/or attached to main structural members 482*a* and 484*a* and/or structural members 486*a*. Electrical wires 490*a* may electrically connect any desired electrical devices (e.g., electrical elements 488*a*) of decorative system 480*a* with electrical component 435*a* via power cord 436*a*. Main structural members 482*a* and 484*a* may also include conductive ground lines 492*a* that may for example be a part of electrical wires 490*a* and/or may be separate elements. For example, electrical wires 490*a* and conductive ground lines 492*a* may form 3-wire connectors that may be disposed in decorative system 480*a* to provide a 3-wire internally wired tree that may be removably attached to base section 430*a*. Also for example, conductive ground lines 492*a* may be electrically connected when main structural members 482*a* and 484*a* are removably attached to each other. Decorative assembly 481*a* may be thereby powered and also grounded to base section 430*a* (e.g., a tree stand) via electrical connection of electrical elements 488*a*, electrical wires 490*a*, conductive ground lines 492*a*, power cord 436*a*, electrical components 420*a* and 435*a*, and electrical power cord 1421*a*.

Figure 19:
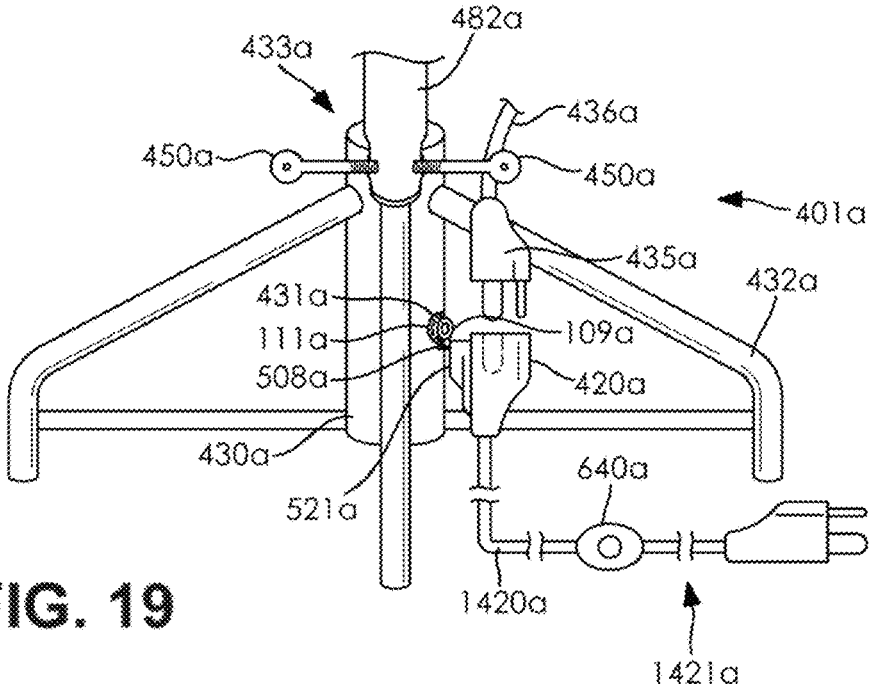
FIG. 19 shows a partially exploded view of the exemplary safety system, according to some embodiments of the present invention.

FIG. 19 illustrates main structural member 482*a* being received in cavity 433*a* of base section 430*a*. As described further herein, fasteners 450*a* may provide conductive contact (e.g., metal-to-metal contact or other suitable contact between conductive materials) between main structural member 482*a* and base section 430*a*.

In at least some exemplary embodiments, electrical assembly 401*a* may include an artificial tree metal stand that may include a 3-wire power cord with a plug that may have a fuse inside it and a power cord that may have a foot pedal switch (e.g., electrical component 640*a*) for off and on control of the power lead passing through it. Electrical assembly 401*a* may include a 3rd wire safety ground that may terminate at a tree stand having a bare spot (for example bare metal ground point portion 431*a*) where a coating such as paint has been removed. A washer (e.g., washer 111*a*) may be disposed in between a 3rd wire terminal and may be secured to the stand (e.g., base section 430*a*) with a tamper proof screw (e.g., fastener 109*a*). The exemplary disclosed tree stand (e.g., including base section 430*a*) may have a 3-wire plug disposed at an end of the cord for connection to 3-wire safety artificial trees and/or polarized 2-wire plug trees (e.g., and/or to 2-wire non-polarized tree wiring, internal and external house voltage and low voltage).

In at least some exemplary embodiments, the exemplary disclosed tree stand (e.g., including base section 430*a*) may be used to provide a 3rd wire safety ground for the exemplary disclosed tree stand and tree pole. The exemplary disclosed system may thereby protect users from accidental shock due to a decorative assembly (e.g., including a 3-wire safety pole or tree) being inadvertently shorted to other devices (e.g., such as unknown Christmas decorations and other nearby devices).

Figure 19A:
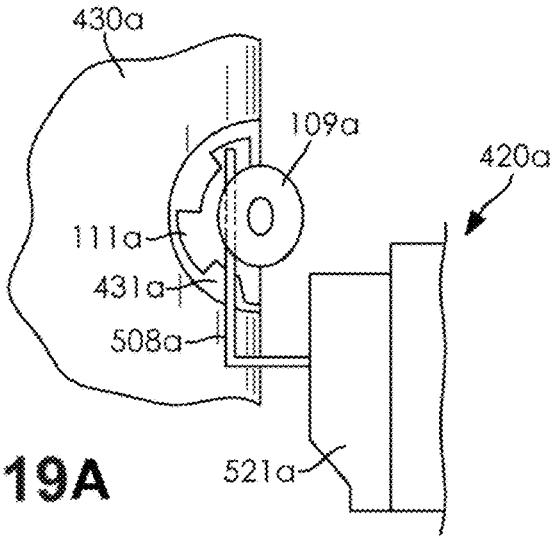
FIG. 19A shows an exemplary detail of the exemplary safety system, according to some embodiments of the present invention.

FIG. 19A illustrates a detailed view of the attachment of electrical component 420*a* to base section 430*a* via ground prong 508*a*. Base section 430*a* may include bare metal ground point portion 431*a*, which may be a portion of base section 430*a* having no paint or other coatings and at which bare metal of base section 430*a* is exposed (e.g., paint or other coatings may be removed). Ground prong 508*a* may be attached to bare metal ground point portion 431*a* via fastener 109*a* (e.g., a screw such as a tamper-proof screw). Electrical connection between electrical component 420*a* and base section 430*a* (e.g., at bare metal ground point portion 431*a*) may be made via ground prong 508*a* and fastener component 111*a* (e.g., and fastener 109*a*).

Figure 19B:
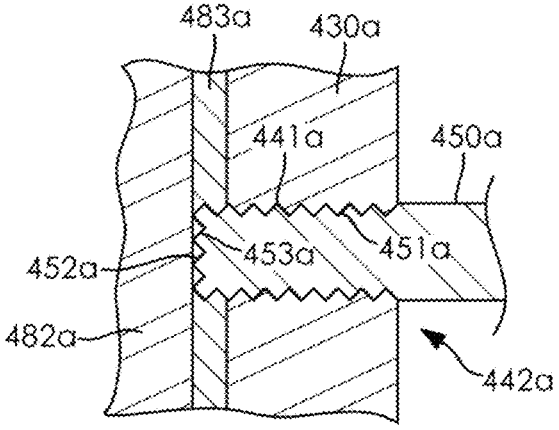
FIG. 19B shows an exemplary detail of the exemplary safety system, according to some embodiments of the present invention.
Figure 20:
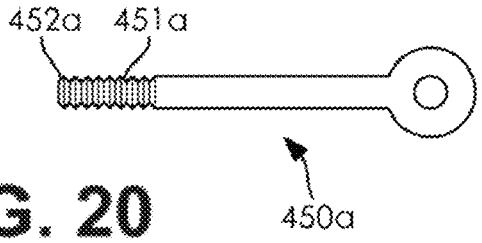
FIG. 20 is a perspective view of an exemplary disclosed fastener, according to some embodiments of the present invention.

FIG. 19B illustrates a detailed view of the exemplary conductive contact (e.g., metal-to-metal contact or other suitable contact between conductive materials) between main structural member 482*a* and base section 430*a*. Fastener 450 may include threading 451*a* that may be received by threading 441*a* of base section 430*a*. For example, fastener 450*a* may be threaded into an aperture 442*a* (e.g., a threaded aperture including threading 441*a*) of base section 430*a* via threading 441*a* and threading 451*a*. Fastener 450*a* may include an abrasive end portion 452*a*. Abrasive end portion 452*a* may have any suitable configuration for removing a portion of a coating 483*a* from main structural member 482*a*. For example, coating 483*a* may be a non-metallic or non-conductive coating such as paint, lacquer, plastic, or any other suitable coating. For example, abrasive end portion 452*a* may include a serrated end portion (e.g., including a plurality of serrations or protrusions 453*a*) configured to remove a portion of coating 483*a* for example as fastener 450*a* is rotated (e.g., via rotation of threading 441*a* and threading 451*a* relative to each other). For example, abrasive end portion 452*a* may be a jagged end portion including a jagged end (e.g., jagged protrusions 453*a*). Abrasive end portion 452*a* may be conductive (e.g., metallic), and may for example be formed from the same conductive (e.g., metallic) material as the rest of fastener 450*a*. As illustrated in FIG. 19B, a portion of coating 483*a* may be removed so that abrasive end portion 452*a* is in direct contact (e.g., direct conductive contact such as metal-to-metal contact) with a surface of main structural member 482*a*. FIG. 20 illustrates a perspective view of fastener 450*a*. In at least some exemplary embodiments, abrasive end portion 452*a* of fastener 450*a* may also be used to remove a coating such as paint from bare metal ground point portion 431*a*.

Figure 21:
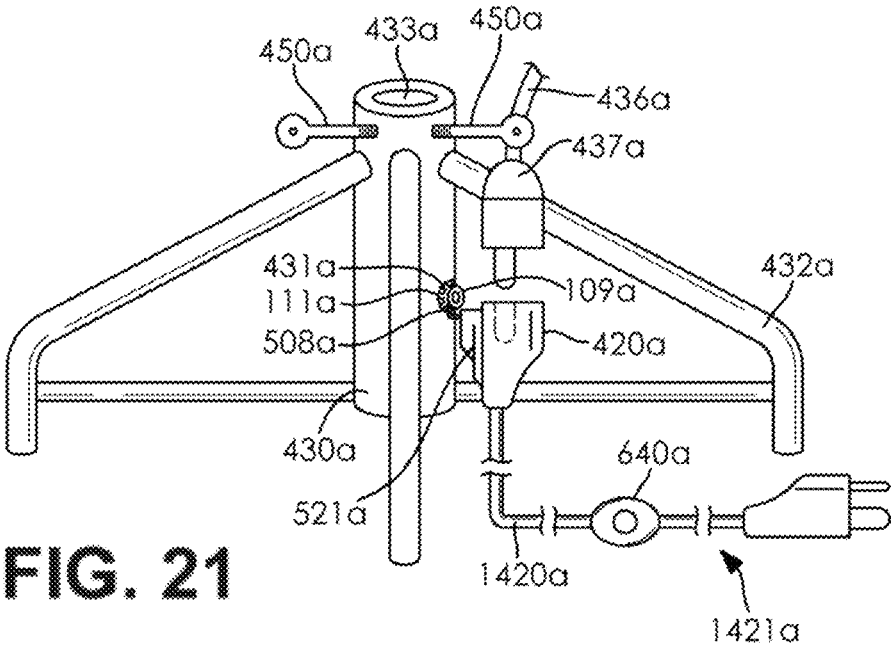
FIG. 21 shows a partially exploded view of another exemplary safety system, according to some embodiments of the present invention.

FIG. 21 illustrates an alternative embodiment of electrical assembly 401*a*. As illustrated in FIG. 21, an electrical component 437*a* may be electrically connected to power cord 436*a*. Electrical component 437*a* may be selectively electrically attached to electrical component 420*a* similarly to electrical component 435*a*. Electrical component 437*a* may be a 2-wire electrical connection. For example, electrical component 437*a* may be a two-prong polarized plug or a two-prong non-polarized plug.

Figure 22:
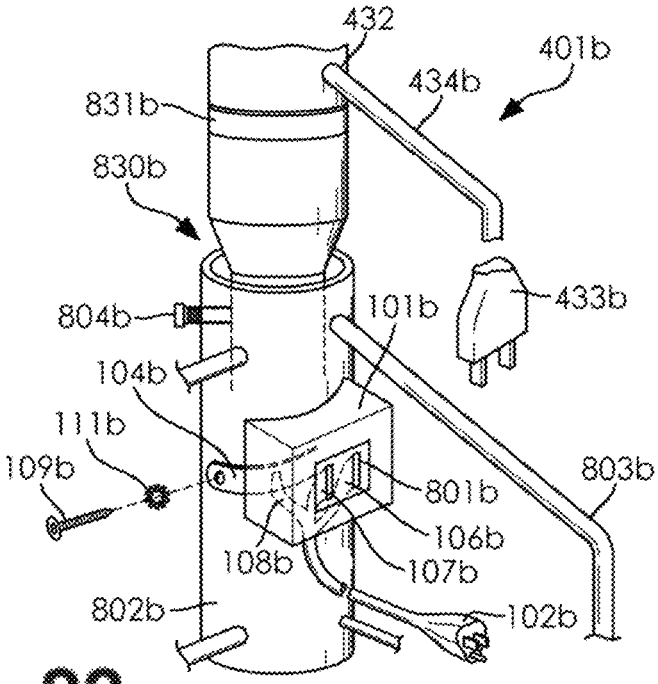
FIG. 22 is a perspective view of another exemplary safety system, according to some embodiments of the present invention.

FIG. 22 illustrates another exemplary embodiment of the exemplary disclosed electrical assembly. In at least some exemplary embodiments, an electrical assembly 401*b* may include a two-wire socket mounted on a base section (e.g., a tree stand). A female power outlet 801*b* may be attached to a base section 802*b*. Base section 802*b* may be similar to base section 430*a*. For example, base section 802*b* may be a portion of a tree stand that may be supported by structural members 803*b* that may be similar to structural members 432*a*. A main structural member 830*b* may be removably attached to base section 802*b*. Main structural member 830*b* may be similar to main structural member 482*a* and may for example be an artificial Christmas tree pole of an artificial Christmas tree that may be similar to decorative assembly 481*a*. A ground connection may be created between main structural member 830*b* and base section 802*b* when they are connected together. Power may be delivered via an electrical member 433*b* (e.g., a plug) connected to main structural member 830*b*, which may removably attach to (e.g., plug into) female power outlet 801*b* that may be attached to base section 802*b*.

As illustrated in FIG. 22, a housing 101*b* (e.g., a molded electrical box 101*b*) may be provided. Molded electrical box 101*b* may include a flange 104*b* on each side for securing molded electrical box 101*b* to base section 802*b* (e.g., an artificial tree stand such as a rounded tree stand). A three-prong safety grounded plug 102*b* may be electrically connected via a hot conductor 106*b*, a neutral conductor 107*b*, and a ground conductor 108*b* to molded electrical box 101*b*. Any suitable connection may be made in and around molded electrical box 101*b* including for example connecting neutral conductor 107*b* and ground conductor 108*b* to each other and fusing hot conductor 106*b*, fusing both hot conductor 106*b* and neutral conductor 107*b*, or passing both hot conductor 106*b* and neutral conductor 107*b* through molded electrical box 101*b* without fusing (e.g., when fusing is done elsewhere on the exemplary disclosed artificial tree).

In at least some exemplary embodiments, molded electrical box 101*b* may include a rounded back that may be molded to fit a curvature of base section 802*b*, which may allow flanges 104*b* and the molded back of molded electrical box 101*b* to abut (e.g., sit flush) against base section 802*b* and provide a secure connection that is less likely to shift or break (e.g., from being bumped or nudged during assembly, disassembly, and/or general use of the exemplary disclosed decorative lighted Christmas tree). Alternatively in at least some exemplary embodiments, molded electrical box 101*b* may also be attached to base section 802*b* via adhesive such as glue, welding, or any other suitable attachment technique.

In at least some exemplary embodiments, flanges 104*b* may be formed from a single piece of conductive material, such as for example metal. Flanges 104*b* may be secured to a ground point on base section 802*b* through a fastener component 111*b* (e.g., a washer such as a star washer) and a fastener 109*b* (e.g., a tamper-proof screw). Conductive flanges 104*b* may also be attached (e.g., welded or attached and/or electrically connected by any other suitable technique) to ground conductor 108*b* of three-prong safety grounded plug 102*b*. A ground connection may thereby be provided via ground conductor 108*b* to base section 802*b* (e.g., a tree stand of an artificial Christmas tree). Neutral conductor 106*b* and hot conductor 107*b* may enter molded electrical box 101*b* and connect to female power outlet 801*b* disposed inside molded electrical box 101*b*. In at least some exemplary embodiments, a fuse may be disposed inside of molded electrical box 101*b* on hot conductor 107*b* or on both hot conductor 107*b* and neutral conductor 106*b*.

In at least some exemplary embodiments and as illustrated in FIG. 22, electrical member 433*b* of main structural member 830*b* may include conductors 434*b* that may enter a hollow body of main structural member 830*b* through a fastener such as a securing grommet 432*b*. To provide for example a ground connection between base section 802*b* and main structural member 830*b*, main structural member 830*b* may have an exposed conductive surface 831*b* (e.g., an exposed metal surface). When main structural member 830*b* is connected to base section 802*b*, exposed conductive surface 831*b* may align with a fastener (e.g., any suitable fastener) such as a connecting screw 804*b* that may pass through base section 802*b*. When connecting screw 804*b* is tightened against exposed conductive surface 831*b* (e.g., within a cavity of base section 802*b*), an electrical ground connection may be created between ground conductor 108*b* and main structural member 830*b* through base section 802*b*.

In at least some exemplary embodiments, female power outlet 801*b* may be a three prong grounded female power outlet and electrical member 433*b* may be a three prong grounded plug. Alternatively for example and as illustrated in FIG. 22, female power outlet 801*b* may be a polarized two-prong power outlet that may receive electrical member 433*b* that may be a polarized plug or a non-polarized plug. Female power outlet 801*b* may also be a three prong grounded power outlet that may receive electrical member 433*b* that may be a polarized three-prong grounded plug, a non-polarized two-prong plug, or a polarized two-prong plug.

In at least some exemplary embodiments, the exemplary disclosed apparatus may include a decorative assembly stand (e.g., including base section 430*a* or base section 802*b*) having a cavity, a decorative assembly member (e.g., main structural member 482*a* or main structural member 830*b*) that may be configured to be removably received in the cavity, a coating that coats a surface of the decorative assembly member, a power socket including an electrical ground line, and a fastener. The electrical ground line may be configured to be electrically connected to a surface of the decorative assembly stand. The fastener may be configured to be received in an aperture of the decorative assembly stand and cut through the coating of the decorative assembly member and contact the surface of the decorative assembly member when the decorative assembly member is received in the cavity of the decorative assembly stand. The electrical ground line may be electrically connected to the surface of the decorative assembly stand by a ground prong of the power socket that contacts the surface of the decorative assembly stand that is a metal surface. The exemplary disclosed apparatus may also include a washer and a screw that electrically attach the ground prong to the surface of the decorative assembly stand. The fastener may include a serrated end portion. The fastener may be a threaded fastener and the aperture may be a threaded aperture. The fastener may cut through the coating based on the serrated end portion rotating as the fastener is threaded through the aperture. The exemplary disclosed apparatus may also include a foot pedal switch that is electrically connected to the socket. The exemplary disclosed apparatus may further include an artificial tree that is supported by the decorative assembly member and that includes a plurality of electrical devices, the plurality of electrical devices electrically connected to the power socket via a power cord having a plug that is removably attachable to the power socket.

In at least some exemplary embodiments, the exemplary disclosed method may include providing a decorative assembly stand (e.g., including base section 430*a* or base section 802*b*) having a cavity, a surface of the decorative assembly member being coated with a coating, removably inserting a decorative assembly member (e.g., main structural member 482*a* or main structural member 830*b*) in the cavity of the decorative assembly stand, and electrically attaching an electrical ground line of a power socket to a surface of the decorative assembly stand. The exemplary disclosed method may also include inserting a fastener through an aperture of the decorative assembly stand when the decorative assembly member is inserted in the decorative assembly stand, and cutting through the coating of the decorative assembly member with the fastener and contacting the surface of the decorative assembly member when the fastener is inserted in the aperture of the decorative assembly stand and the decorative assembly member is inserted in the cavity of the decorative assembly stand. The exemplary disclosed method may further include supporting an artificial tree with the decorative assembly member, the artificial tree including a plurality of electrical devices that are electrically connected to a power cord having a plug. The exemplary disclosed method may additionally include removably plugging the plug into the power socket, and removably plugging a second power cord, which may be permanently attached to the power socket and that may include a foot pedal switch, to an external power source. The fastener may be a threaded fastener having an abrasive end portion and the aperture is a threaded aperture. Cutting through the coating of the decorative assembly member with the fastener may include rotatably scraping the coating with the abrasive end portion while threading the fastener through the aperture. Electrically attaching the electrical ground line of the power socket to the surface of the decorative assembly stand may include attaching a ground prong of the power socket to the surface that is a metal surface with a screw and a washer.

In at least some exemplary embodiments, the exemplary disclosed grounded artificial tree stand assembly may include an artificial tree stand (e.g., including base section 430*a* or base section 802*b*) having a cavity, an artificial tree pole (e.g., main structural member 482*a* or main structural member 830*b*) that is removably received in the cavity, a coating that coats a surface of the artificial tree pole, a power socket including an electrical ground line, and a fastener. The electrical ground line may be electrically connected to a surface of the artificial tree stand. The fastener may be received in an aperture of the decorative assembly stand and may extend through a hole in the coating of the artificial tree pole when the artificial tree pole is removably received in the cavity. A jagged end portion of the fastener may contact the surface of the artificial tree pole. The hole in the coating may be a scraped hole formed by the jagged end portion when the fastener that may be threaded is rotated through the aperture of the decorative assembly stand that may be threaded. The coating may be paint or plastic and the surface of the artificial tree pole may be a metal surface. The exemplary disclosed grounded artificial tree stand assembly may also include an artificial tree that may be supported by the artificial tree pole and that may include a plurality of LEDs, the plurality of LEDs being electrically connected to the power socket via a power cord having a plug that may be removably attachable to the power socket. The power socket may be a two-prong polarized plug, a two-prong non-polarized plug, or a three-prong grounded plug.

Figure 23:
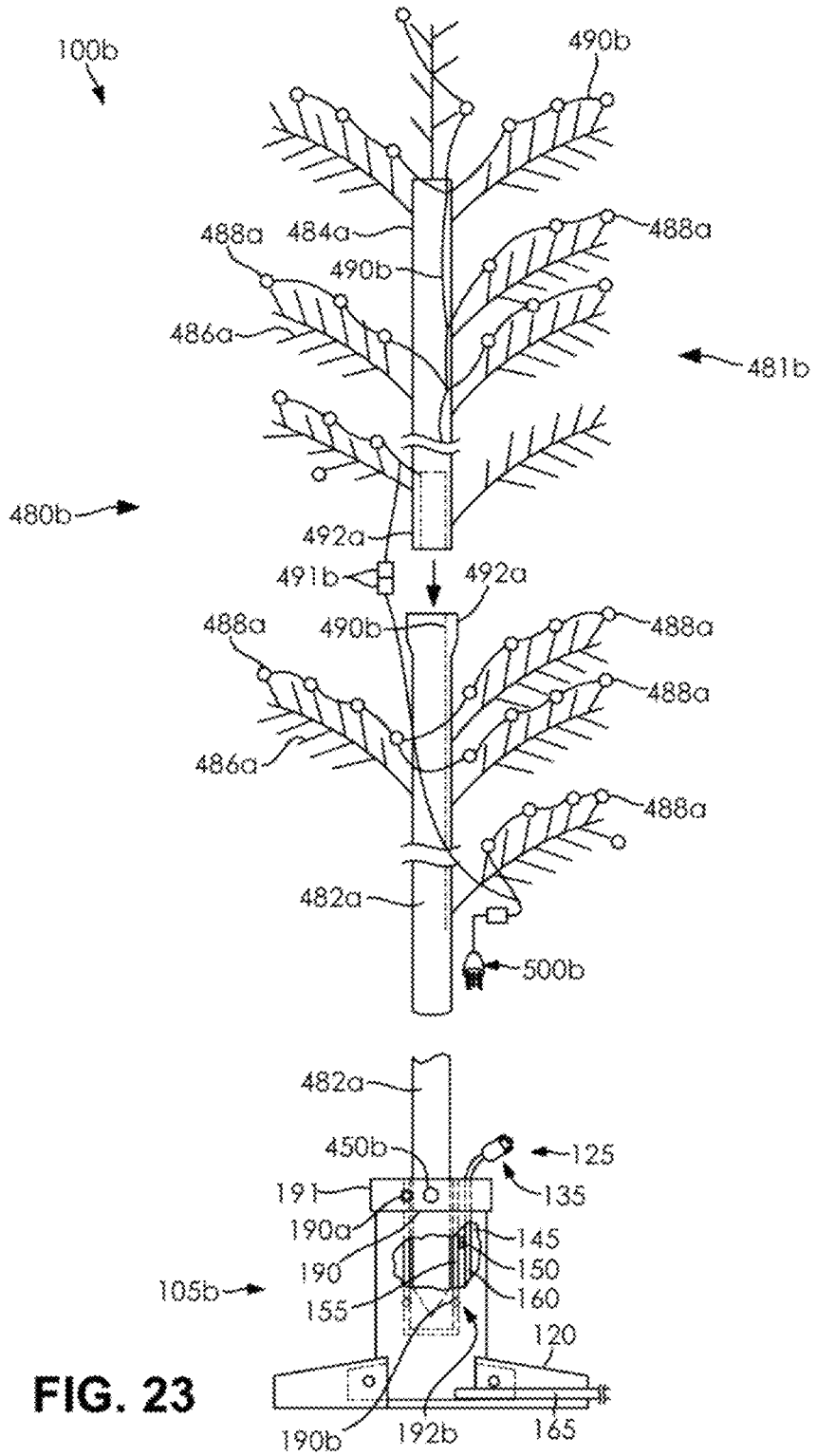
FIG. 23 is a illustrates a side view of at least some exemplary embodiments of the present disclosure.

FIG. 23 illustrates another exemplary embodiment of the exemplary disclosed system, apparatus, and method. An exemplary disclosed system 100*b* may include a decorative system 480*b* having a decorative assembly 481*b* that may be generally similar to decorative assembly 481*a*. Decorative assembly 481*b* may include a plurality of electrical connectors 490*b* that may be electrically connected to electrical elements 488*a* (e.g., LEDs or other suitable lighting components). Electrical connectors 490*b* may be any suitable electrical connectors such as power cords, electrical wires, or any other suitable electrical connectors. Electrical connectors 490*b* may be electrically connected to each other by electrical connectors 491*b* (e.g., electrical plugs and/or sockets or any other suitable electrical component configured to connect to each other). One or more of electrical connectors 490*b* may include an electrical component 500*b*. Electrical component 500*b* may be any suitable electrical connector such as, for example, a polarized or nonpolarized electrical connector. In at least some exemplary embodiments, electrical component 500*b* may be a polarized or non-polarized two-blade or two-prong AC electrical connector (e.g., plug). Electrical component 500*b* may be any suitable two-prong or three-prong AC or DC electrical connector (e.g., plug or socket). Electrical component 500*b* may be removably electrically connected to electrical component 135.

Exemplary disclosed system 100*b* may include an assembly 105*b* that may be generally similar to assembly 105. Assembly 105*b* may include a grounding connection for example as illustrated in FIG. 23. For example, assembly 105*b* may include a ball bearing grounding connection. For example, assembly 105*b* may include a movable assembly 190 that may be generally similar for example to the exemplary disclosed movable assemblies disclosed herein. Movable assembly 190 may be a rotating assembly (e.g., rotating collar) that may rotate relative to an assembly 191 (e.g., a collar). A grounding connection 190*a* and/or a grounding connection 190*b* may each include a ball bearing. Grounding connections 190*a* and/or 190*b* may electrically connect (electrically ground) movable assembly 190 and assembly 191. For example, grounding connections 190*a* and/or 190*b* may include ball bearings that may operate similarly to the exemplary disclosed ball bearings disclosed herein. Grounding connection 190*a* may include a ball bearing that may be disposed at a level of assembly 191 (e.g., including a collar) and may electrically connect movable assembly 190 and assembly 191. Grounding connection 190*b* may include a ball bearing that may be disposed at a level of a conductive member 192*b* (e.g., conductive cup) as illustrated in FIG. 23 and may electrically connect movable assembly 190 and assembly 191. In at least some exemplary embodiments, either grounding connection 190*a* or grounding connection 190*b* may be provided, or both grounding connection 190*a* and grounding connection 190*b* may be provided.

Also as illustrated in FIG. 23, a fastener 450*b* may be disposed in assembly 105*b*. Fastener 450*b* may be similar to fastener 450*a*. Fastener 450*b* may electrically connect main structural member 482*a* to movable assembly 190 for example as described below regarding FIG. 30.

Figure 24:
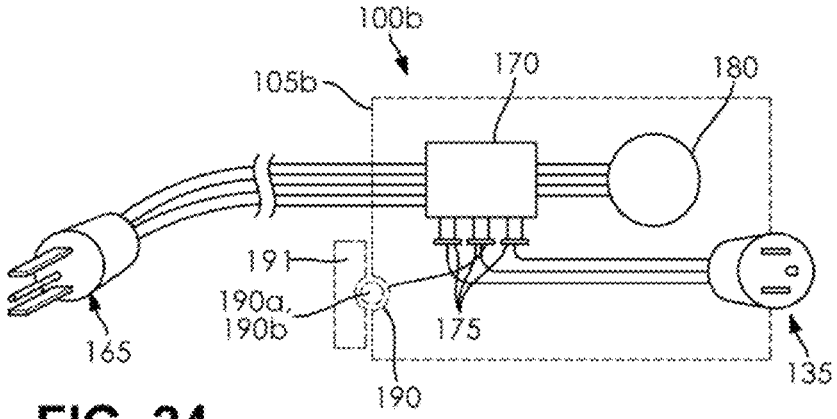
FIG. 24 illustrates a schematic view of at least some exemplary embodiments of the present disclosure.

FIG. 24 schematically illustrates a circuit diagram of system 100*b*, which may be generally similar to the schematic illustration of system 100 in FIG. 2. FIG. 24 schematically illustrates the electrical connection between movable assembly 190 and assembly 191 via grounding connection 190*a* and/or grounding connection 190*b* (e.g., as also illustrated for example in FIG. 23 and described above). As illustrated in FIG. 24, movable assembly 190, assembly 191, and grounding connection 190*a* and/or grounding connection 190*b* may be electrically connected to contactor 170 (e.g., to one or more contact strips 175). In at least some exemplary embodiments, grounding connection 190*a* and/or grounding connection 190*b* may provide a ball bearing connection for grounding to movable assembly 190 and assembly 191.

Figure 25:
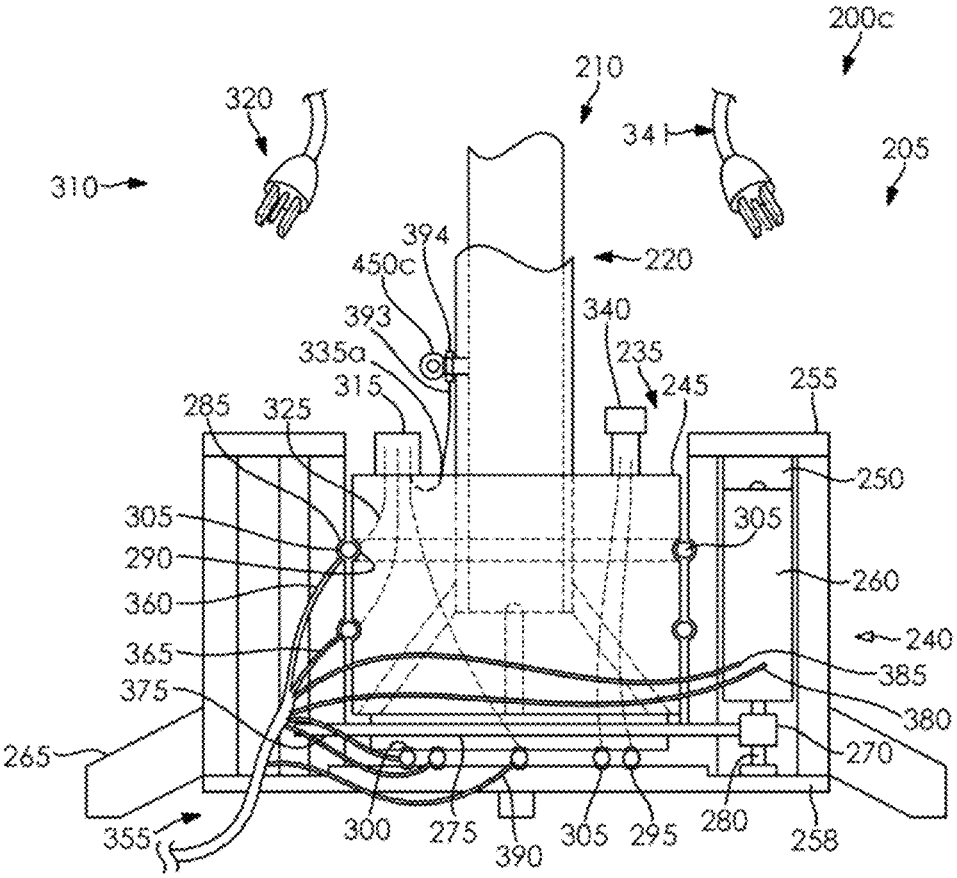
FIG. 25 illustrates a schematic view of at least some exemplary embodiments of the present disclosure.

FIG. 25 illustrates an exemplary system 200*c* that may be generally similar to system 200 illustrated in FIG. 3 as described for example above. System 200*c* may include a safety ground wire 393 that may electrically connect electrical member 335*a* (e.g., a third wire safety) to a fastener 394. For example, fastener 394 may be a grounding clip that may be attached to a fastener 450*c* that may be similar to fasteners 450*a* and 450*b* (e.g., or fasteners 115 and 215). For example, safety ground wire 393 and fastener 394 may be added to connect electrical member 335*a* (e.g., a 3rd wire from a 3-wire socket connection as illustrated in FIG. 25) to fastener 450*c* (e.g., a securing bolt). Safety ground wire 393 may thereby electrically connect rotatable assembly 235 to member 210 via safety ground wire 393, fastener 394, and fastener 450*c*.

Figure 26:
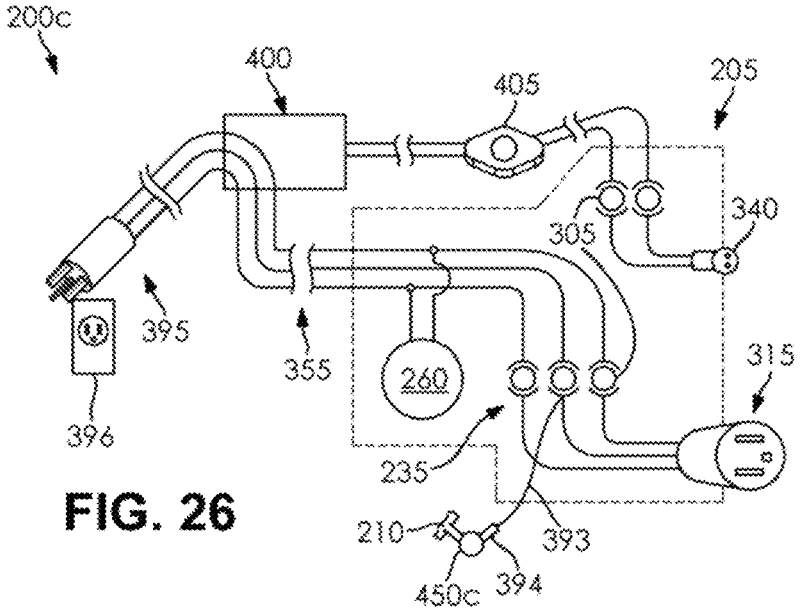
FIG. 26 illustrates a schematic view of at least some exemplary embodiments of the present disclosure.

FIG. 26 schematically illustrates a circuit diagram of system 200*c*, which may be generally similar to the schematic illustration of system 200 in FIG. 4. FIG. 26 schematically illustrates the electrical connection between safety ground wire 393 and fastener 394, which may electrically connect rotatable assembly 235 (e.g., rotary stand) to member 210 via fastener 450*c* (e.g., as also illustrated for example in FIG. 25 and described above).

Figure 27:
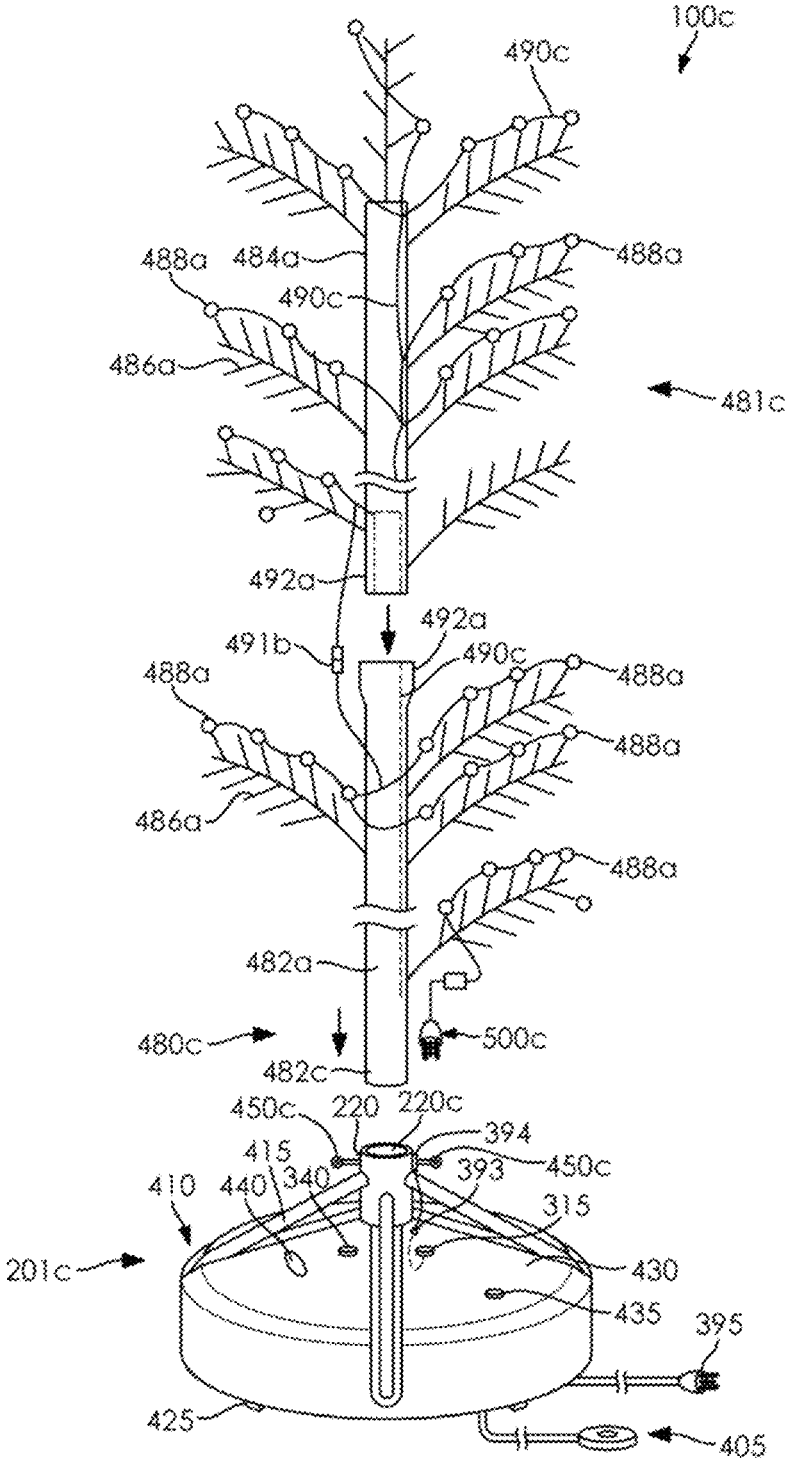
FIG. 27 is a perspective view of least some exemplary embodiments of the present disclosure.

FIG. 27 illustrates another exemplary embodiment of the exemplary disclosed system, apparatus, and method. An exemplary disclosed system 100*c* may include a decorative system 480*c* having a decorative assembly 481*c* that may be generally similar to system 100*b* including decorative system 480*b* having decorative assembly 481*b*. Decorative assembly 481*c* may include one or more of electrical connectors 490*c* that may be similar to electrical connector 490*b* and that may include an electrical component 500*c* that may be similar to electrical component 500*b*. System 100*c* may also include a system 201*c* that may be generally similar to system 200*c* described above regarding FIG. 25 and system 200 described above regarding FIG. 5. Electrical component 500*c* may be removably electrically connected to an electrical component of system 201*c* (e.g., electrical component 315 or electrical component 340).

As illustrated in FIG. 27, an end portion 482*c* of main structural member 482*a* may be removably received in a cavity 220*c* of housing 220. When end portion 482*c* of main structural member 482*a* is received in cavity 220*c*, one or more fasteners 450*c* may be inserted in an aperture of housing 220. Fastener 450*c* may remove a coating from end portion 482*c* of main structural member 482*a* (e.g., cuts through paint) and contact a conductive surface of end portion 482*c* similarly to as described above regarding fastener 450*a*. Similarly to as described above regarding FIGS. 25 and 26, safety ground wire 393 and fastener 394 may electrically connect fastener 450*c* to electrical component 315 (e.g., to rotatable assembly 235). Main structural member 482*a* (e.g., a pole) may thereby be grounded on system 201*c* (e.g., a rotary stand). In at least some exemplary embodiments, main structural member 482*a* being grounded on system 201*c* may be a grounded pole on a rotary stand.

Figure 28:
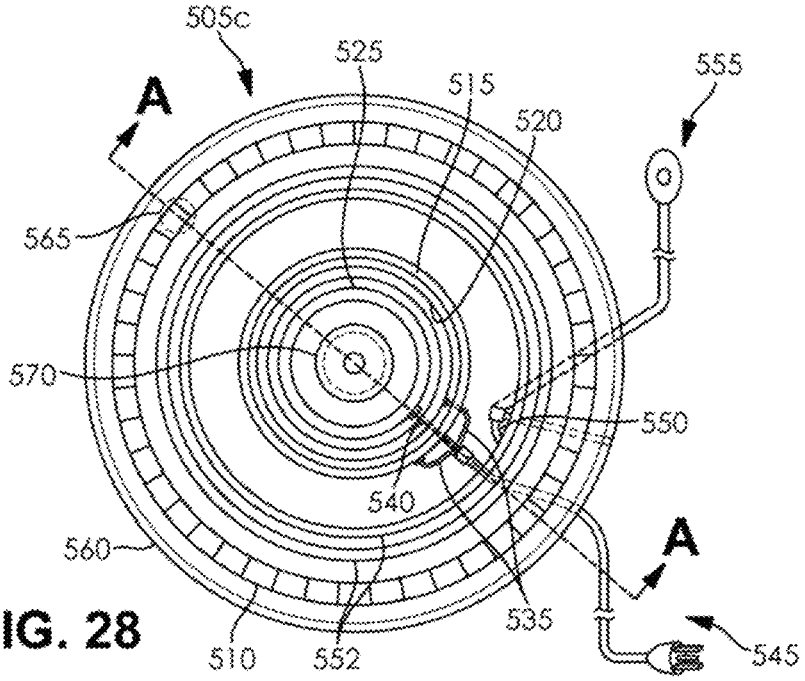
FIG. 28 illustrates a top view of the bottom of a tree stand base of at least some exemplary embodiments of the present disclosure.
Figure 29:
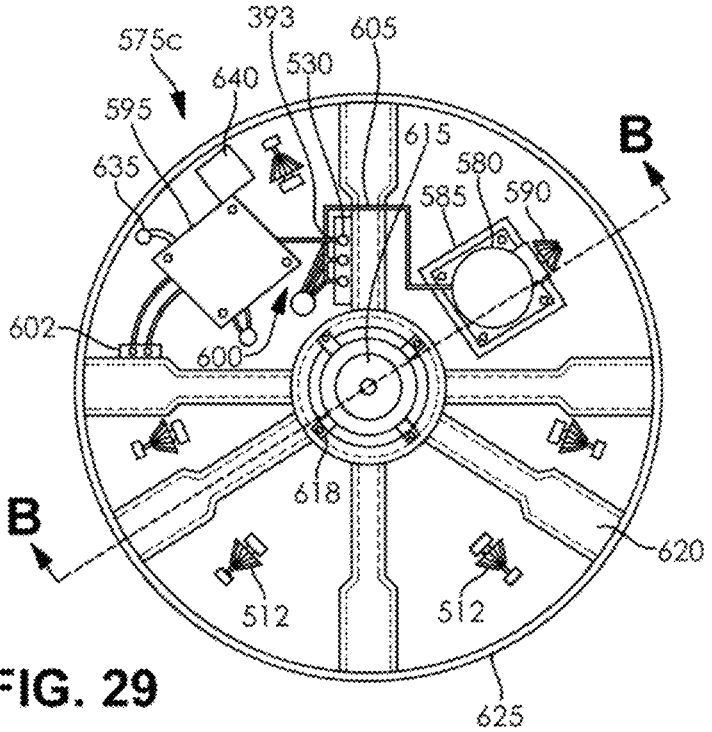
FIG. 29 illustrates a bottom view of the top of a tree stand base of at least some exemplary embodiments of the present disclosure.

FIG. 28 illustrates a base assembly 505*c* that may be similar to base assembly 505. FIG. 29 illustrates a base cover assembly 575*c* that may be generally similar to base cover assembly 575. Base assembly 505*c* and base cover assembly 575*c* may form a system that may operate similarly to system 201*c* illustrated in FIG. 27. For example, the system formed by base assembly 505*c* and base cover assembly 575*c* may operate with decorative system 480*c* similarly to system 201*c* as described above regarding FIG. 27. For example, safety ground wire 393 may be disposed on base cover assembly 575*c* and may extend out of the system (e.g., stand) formed by base assembly 505*c* and base cover assembly 575*c* similarly to as illustrated in FIG. 27.

Figure 30:
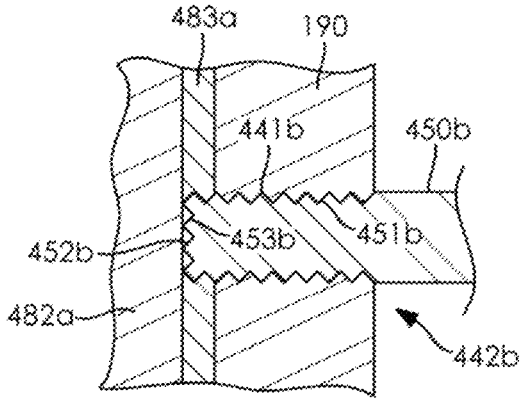
FIG. 30 shows an exemplary detail of the exemplary safety system, according to some embodiments of the present invention.
Figure 31:
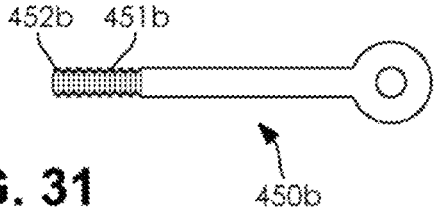
FIG. 31 shows an exemplary detail of the exemplary safety system, according to some embodiments of the present invention.

FIG. 30 and FIG. 31 illustrate fastener 450*b*, which may be similar to fastener 450*a*. Fastener 450*b* may include threading 451*b*, abrasive end portion 452*b*, and a plurality of serrations or protrusions 453*b* that may be similar to threading 451*a*, abrasive end portion 452*a*, and a plurality of serrations or protrusions 453*a*, respectively. Fastener 450*b* may be received in an aperture 442*b* of movable assembly 190 that may include threading 441*b*. Abrasive end portion 452*b* may remove a portion of coating 483*a* to expose a conductive surface of main structural member 482*a* as illustrated in FIG. 30 and similarly to as described above regarding FIG. 19B. Fastener 450*c* may be similarly threaded through an aperture of housing 220 to remove a portion of coating from a surface of end portion 482*c* similarly to as described above regarding FIG. 30.

Figure 32:
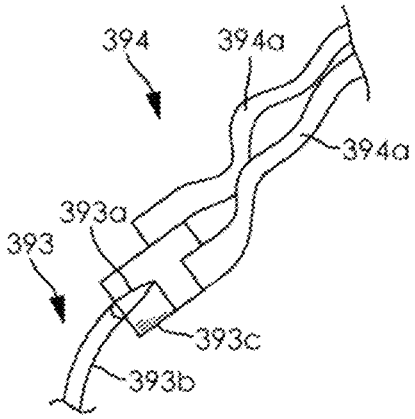
FIG. 32 shows an exemplary detail of the exemplary safety system, according to some embodiments of the present invention.

FIG. 32 illustrates an exemplary embodiment of fastener 394 and a connection between safety ground wire 393 and fastener 394. Fastener 394 may include a plurality of members 394*a*. Members 394*a* may be clip members of fastener 394 that may be a spring conductor clip. For example, members 394*a* may be elastic or resilient members that may elastically deform (e.g., deform from a stretched to an original shape) to be able to clip or fasten onto members such as fasteners 450*b* and 450*c*. Fastener 394 may be formed from any suitable conductive material such as metal. For example, fastener 394 may be formed from copper material. Fastener 394 may be formed from a spring copper material. Fastener 394 may be attached to safety ground wire 393 by any suitable technique. For example, safety ground wire 393 may be welded to fastener 394. Safety ground wire 393 may include a ground wire 393*a* that may be housed in or surrounded by an insulating layer 393*b*. Insulating layer 393*b* may be any suitable non-conductive material such as rubber, elastomeric material, resin material, and/or any other suitable insulative material. Ground wire 393*a* may extend from insulating layer 393*b* and may be welded or attached by any other suitable technique (e.g., adhesive, mechanical attachment, or any other suitable technique) to fastener 394 as illustrated in FIG. 32. For example, a weld 393*c* (e.g., a connecting weld such as a metal weld) may attach ground wire 393*a* to fastener 394.

In at least some exemplary embodiments and as illustrated in FIGS. 23 to 32, the exemplary disclosed system may include a decorative assembly (e.g., an artificial tree for example having a metal pole) having a 2-blade plug or a 2-prong plug. The decorative assembly (e.g., metal pole) may be provided with a safety ground on a 3-wire safety-grounded tree stand. The exemplary disclosed system may allow for a decorative assembly (e.g., artificial tree) that does not have a 3-wire safety lighting system and/or does not have a grounded pole to be able to ground its pole (e.g., have its pole grounded). For example, such a decorative assembly may have its pole received in a safety-grounded 3-wire rotary tree stand to have its pole grounded via a securing fastener or bolt (e.g., via fastener 350*b* or fastener 350*c*).

In at least some exemplary embodiments, the exemplary disclosed apparatus may include a decorative assembly stand including an assembly supporting a movable assembly, the movable assembly having a cavity, a decorative assembly member (e.g., main structural member 482*a* or member 210) that is configured to be removably received in the cavity, a coating that coats a surface of the decorative assembly member, a first fastener (e.g., fastener 450*b* or fastener 450*c*), and a second fastener configured to be removably electrically connected to the first fastener. The second fastener may be electrically connected to the movable assembly. The first fastener may be configured to be received in an aperture of the movable assembly and cut through the coating of the decorative assembly member and contact the surface of the decorative assembly member when the decorative assembly member is received in the cavity of the decorative assembly stand. The movable assembly may be electrically connected to the assembly via at least one ball bearing supported in an elongated cavity formed between a first recess of the movable assembly and a second recess of the assembly. The second fastener may be a grounding clip formed from a spring copper material. The grounding clip may be welded to an electrical wire that is electrically connected to the movable assembly. The electrical wire may be electrically connected to a third wire of a three-wire socket of the movable assembly. The movable assembly may be a rotatable collar that is rotatably supported by the assembly, the decorative assembly stand is an artificial tree stand, and the decorative assembly member is an artificial tree pole. The first fastener may include a serrated end portion. The first fastener may be a threaded fastener and the aperture may be a threaded aperture. The first fastener may cut through the coating based on the serrated end portion rotating as the first fastener is threaded through the aperture. The decorative assembly member may be electrically connected to a plug that may be removably attachable to a socket that is electrically connected to the movable assembly. The plug may be a two-blade polarized plug or a two-blade non-polarized plug.

In at least some exemplary embodiments, the exemplary disclosed method may include providing a decorative assembly stand including an assembly supporting a movable assembly, the movable assembly having a cavity, removably inserting a decorative assembly member (e.g., main structural member 482*a* or member 210) in the cavity of the movable assembly, the surface of the decorative assembly member being coated with a coating, inserting a first fastener (e.g., fastener 450*b* or fastener 450*c*) through an aperture of the movable assembly when the decorative assembly member is inserted in the cavity of the movable assembly, cutting through the coating of the decorative assembly member with the first fastener and contacting the surface of the decorative assembly member when the first fastener is inserted in the aperture of the movable assembly and the decorative assembly member is inserted in the cavity of the movable assembly, and removably electrically connecting a second fastener to the first fastener. The second fastener may be electrically connected to the movable assembly. The first fastener may be a threaded fastener having an abrasive end portion and the aperture is a threaded aperture. Cutting through the coating of the decorative assembly member with the first fastener may include rotatably scraping the coating with the abrasive end portion while threading the first fastener through the aperture. The exemplary disclosed method may include electrically connecting the movable assembly to the assembly via at least one ball bearing supported in an elongated cavity formed between a first recess of the movable assembly and a second recess of the assembly. The exemplary disclosed method may include rotating the movable assembly while supported by the assembly and while maintaining electrical connection between the movable assembly and the assembly via the at least one ball bearing. An electrical wire may be electrically connected between the second fastener and a third wire of a three-wire socket of the movable assembly.

In at least some exemplary embodiments, the exemplary disclosed apparatus may include a decorative assembly stand including an assembly supporting a rotatable assembly, the rotatable assembly having a cavity, a pole (e.g., main structural member 482*a* or member 210) that may be removably received in the cavity, a coating that may coat a surface of the pole, a first fastener (e.g., fastener 450*b* or fastener 450*c*), and a second fastener that may be removably electrically connected to the first fastener. The second fastener may be electrically connected to the rotatable assembly. The first fastener may be received in an aperture of the rotatable assembly and extends through a hole in the coating of the pole when the pole is removably received in the cavity. A jagged end portion of the first fastener may contact the surface of the pole. The rotatable assembly may be electrically connected to the assembly via at least one ball bearing supported in an elongated cavity formed between a first recess of the rotatable assembly and a second recess of the assembly. The pole may be electrically connected to a two-blade plug that is removably attachable to a socket that is electrically connected to the rotatable assembly.

The exemplary disclosed system, apparatus, and method may be used in any suitable application for providing an electrical safety circuit. The exemplary disclosed system, apparatus, and method may also be used in any suitable application for grounding an electrical device. For example, the exemplary disclosed system, apparatus, and method may be used in any application involving grounding a decorative lighting assembly and/or any other suitable device that may be grounded. In at least some exemplary embodiments, the exemplary disclosed system, apparatus, and method may be used in any suitable application for grounding a rotating artificial tree stand.

The exemplary disclosed system, apparatus, and method may provide an efficient and effective technique for providing an electrical safety circuit. For example, the exemplary disclosed system, apparatus, and method may provide an efficient and effective technique for grounding an artificial decorative display. For example, some exemplary embodiments may provide effective grounding of an artificial tree. In at least some exemplary embodiments, the exemplary disclosed system, apparatus, and method may provide effective grounding for a rotating tree stand.

In the Summary above and in this Detailed Description, and the claims below, and in the accompanying drawings, reference is made to particular features of various embodiments of the invention. It is to be understood that the disclosure of embodiments of the invention in this specification includes all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

In the present disclosure, various features may be described as being optional, for example, through the use of the verb "may;", or, through the use of any of the phrases: "in some embodiments," "in some implementations," "in some designs," "in various embodiments," "in various implementations,", "in various designs," "in an illustrative example," or "for example;" or, through the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features or with all three of the three possible features.

In various embodiments. elements described herein as coupled or connected may have an effectual relationship realizable by a direct connection or indirectly with one or more other intervening elements.

In the present disclosure, the term "any" may be understood as designating any number of the respective elements, i.e. as designating one, at least one, at least two, each or all of the respective elements. Similarly, the term "any" may be understood as designating any collection(s) of the respective elements, i.e. as designating one or more collections of the respective elements, a collection comprising one, at least one, at least two, each or all of the respective elements. The respective collections need not comprise the same number of elements.

While various embodiments of the present invention have been disclosed and described in detail herein, it will be apparent to those skilled in the art that various changes may be made to the configuration, operation and form of the invention without departing from the spirit and scope thereof. In particular, it is noted that the respective features of embodiments of the invention, even those disclosed solely in combination with other features of embodiments of the invention, may be combined in any configuration excepting those readily apparent to the person skilled in the art as nonsensical. Likewise, use of the singular and plural is solely for the sake of illustration and is not to be interpreted as limiting.

In the present disclosure, all embodiments where "comprising" is used may have as alternatives "consisting essentially of," or "consisting of." In the present disclosure, any method or apparatus embodiment may be devoid of one or more process steps or components. In the present disclosure, embodiments employing negative limitations are expressly disclosed and considered a part of this disclosure.

Certain terminology and derivations thereof may be used in the present disclosure for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "comprises" and grammatical equivalents thereof are used herein to mean that other components, ingredients, steps, among others, are optionally present. For example, an embodiment "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose limit is the second number. For example, 25 to 100 mm means a range whose lower limit is 25 mm and upper limit is 100 mm.

Many suitable methods and corresponding materials to make each of the individual parts of embodiment apparatus are known in the art. According to an embodiment of the present invention, one or more of the parts may be formed by machining, 3D printing (also known as "additive" manufacturing), CNC machined parts (also known as "subtractive" manufacturing), and injection molding, as will be apparent to a person of ordinary skill in the art. Metals, wood, thermoplastic and thermosetting polymers, resins and elastomers as may be described herein-above may be used. Many suitable materials are known and available and can be selected and mixed depending on desired strength and flexibility, preferred manufacturing method and particular use, as will be apparent to a person of ordinary skill in the art.

Any element in a claim herein that does not explicitly state "means for" performing a specified function, or "step for" performing a specific function, is not to be interpreted as a "means" or "step" clause as specified in 35 U.S.C. § 112 (f). Specifically, any use of "step of" in the claims herein is not intended to invoke the provisions of 35 U.S.C. § 112 (f).

According to an embodiment of the present invention, the system and method may be accomplished through the use of one or more computing devices. One of ordinary skill in the art would appreciate that an exemplary system appropriate for use with embodiments in accordance with the present application may generally include one or more of a Central processing Unit (CPU), Random Access Memory (RAM), a storage medium (e.g., hard disk drive, solid state drive, flash memory, cloud storage), an operating system (OS), one or more application software, a display element, one or more communications means, or one or more input/output devices/means. Examples of computing devices usable with embodiments of the present invention include, but are not limited to, proprietary computing devices, personal computers, mobile computing devices, tablet PCs, mini-PCs, servers or any combination thereof. The term computing device may also describe two or more computing devices communicatively linked in a manner as to distribute and share one or more resources, such as clustered computing devices and server banks/farms. One of ordinary skill in the art would understand that any number of computing devices could be used, and embodiments of the present invention are contemplated for use with any computing device.

In various embodiments, communications means, data store(s), processor(s), or memory may interact with other components on the computing device, in order to effect the provisioning and display of various functionalities associated with the system and method detailed herein. One of ordinary skill in the art would appreciate that there are numerous configurations that could be utilized with embodiments of the present invention, and embodiments of the present invention are contemplated for use with any appropriate configuration.

According to an embodiment of the present invention, the communications means of the system may be, for instance, any means for communicating data over one or more networks or to one or more peripheral devices attached to the system. Appropriate communications means may include, but are not limited to, circuitry and control systems for providing wireless connections, wired connections, cellular connections, data port connections, Bluetooth connections, or any combination thereof. One of ordinary skill in the art would appreciate that there are numerous communications means that may be utilized with embodiments of the present invention, and embodiments of the present invention are contemplated for use with any communications means.

Throughout this disclosure and elsewhere, block diagrams and flowchart illustrations depict methods, apparatuses (i.e., systems), and computer program products. Each element of the block diagrams and flowchart illustrations, as well as each respective combination of elements in the block diagrams and flowchart illustrations, illustrates a function of the methods, apparatuses, and computer program products. Any and all such functions ("disclosed functions") can be implemented by computer program instructions; by special-purpose, hardware-based computer systems; by combinations of special purpose hardware and computer instructions; by combinations of general purpose hardware and computer instructions; and so on—any and all of which may be generally referred to herein as a "circuit," "module," or "system."

While the foregoing drawings and description may set forth functional aspects of the disclosed systems, no particular arrangement of software for implementing these functional aspects should be inferred from these descriptions unless explicitly stated or otherwise clear from the context.

Each element in flowchart illustrations may depict a step, or group of steps, of a computer-implemented method. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

Traditionally, a computer program consists of a sequence of computational instructions or program instructions. It will be appreciated that a programmable apparatus (i.e., computing device) can receive such a computer program and, by processing the computational instructions thereof, produce a further technical effect.

A programmable apparatus may include one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computer can include any and all suitable combinations of at least one general purpose computer, special-purpose computer, programmable data processing apparatus, processor, processor architecture, and so on.

It will be understood that a computer can include a computer-readable storage medium and that this medium may be internal or external, removable and replaceable, or fixed. It will also be understood that a computer can include a Basic Input/Output System (BIOS), firmware, an operating system, a database, or the like that can include, interface with, or support the software and hardware described herein.

Embodiments of the system as described herein are not limited to applications involving conventional computer programs or programmable apparatuses that run them. It is contemplated, for example, that embodiments of the invention as claimed herein could include an optical computer, quantum computer, analog computer, or the like.

Regardless of the type of computer program or computer involved, a computer program can be loaded onto a computer to produce a particular machine that can perform any and all of the disclosed functions. This particular machine provides a means for carrying out any and all of the disclosed functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

In some embodiments, computer program instructions may be stored in a computer-readable memory capable of directing a computer or other programmable data processing apparatus to function in a particular manner. The instructions stored in the computer-readable memory constitute an article of manufacture including computer-readable instructions configured to implement any and all of the disclosed functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

The elements depicted in flowchart illustrations and block diagrams throughout the figures imply logical boundaries between the elements. However, according to software or hardware engineering practices, the disclosed elements and the functions thereof may be implemented as parts of a monolithic software structure, as standalone software modules, or as modules that employ external routines, code, services, and so forth, or any combination of these. All such implementations are within the scope of the present disclosure.

Unless explicitly stated or otherwise clear from the context, the verbs "execute" and "process" are used interchangeably to indicate execute, process, interpret, compile, assemble, link, load, any and all combinations of the foregoing, or the like. Therefore, embodiments that execute or process computer program instructions, computer-executable code, or the like can suitably act upon the instructions or code in any and all of the ways just described.

The functions and operations presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will be apparent to those of skill in the art, along with equivalent variations. In addition, embodiments of the invention are not described with reference to any particular programming language. It is appreciated that a variety of programming languages may be used to implement the present teachings as described herein, and any references to specific languages are provided for disclosure of enablement and best mode of embodiments of the invention. Embodiments of the invention are well suited to a wide variety of computer network systems over numerous topologies. Within this field, the configuration and management of large networks include storage devices and computers that are communicatively coupled to dissimilar computers and storage devices over a network, such as the Internet.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

While multiple embodiments are disclosed, still other embodiments of the present disclosure will become apparent to those skilled in the art from this detailed description. There may be aspects of this disclosure that may be practiced without the implementation of some features as they are described. It should be understood that some details have not been described in detail in order to not unnecessarily obscure the focus of the disclosure. The disclosure is capable of myriad modifications in various obvious aspects, all without departing from the spirit and scope of the present disclosure. Accordingly, the drawings and descriptions are to be regarded as illustrative rather than restrictive in nature.

What is claimed is:

1. An apparatus, comprising:

a decorative assembly stand including an assembly supporting a movable assembly, the movable assembly having a cavity;

a decorative assembly member that is configured to be removably received in the cavity;

a coating that coats a surface of the decorative assembly member;

a first fastener; and a second fastener configured to be removably electrically connected to the first fastener;

wherein the second fastener is electrically connected to the movable assembly;

wherein the first fastener is configured to be received in an aperture of the movable assembly and cut through the coating of the decorative assembly member and contact the surface of the decorative assembly member when the decorative assembly member is received in the cavity of the movable assembly.

2. The apparatus of claim 1, wherein the movable assembly is electrically connected to the assembly via at least one ball bearing supported in an elongated cavity formed between a first recess of the movable assembly and a second recess of the assembly.

3. The apparatus of claim 1, wherein the second fastener is a grounding clip formed from a spring copper material.

4. The apparatus of claim 3, wherein the grounding clip is welded to an electrical wire that is electrically connected to the movable assembly.

5. The apparatus of claim 4, wherein the electrical wire is electrically connected to a third wire of a three-wire socket of the movable assembly.

6. The apparatus of claim 1, wherein the movable assembly is a rotatable collar that is rotatably supported by the assembly, the decorative assembly stand is an artificial tree stand, and the decorative assembly member is an artificial tree pole.

7. The apparatus of claim 1, wherein the first fastener includes a serrated end portion.

8. The apparatus of claim 7, wherein the first fastener is a threaded fastener and the aperture is a threaded aperture.

9. The apparatus of claim 8, wherein the first fastener cuts through the coating based on the serrated end portion rotating as the first fastener is threaded through the aperture.

10. The apparatus of claim 1, wherein the decorative assembly member is electrically connected to a plug that is removably attachable to a socket that is electrically connected to the movable assembly.

11. The apparatus of claim 10, wherein the plug is a two-blade polarized plug or a two-blade non-polarized plug.

12. A method, comprising:

providing a decorative assembly stand including an assembly supporting a movable assembly, the movable assembly having a cavity;

removably inserting a decorative assembly member in the cavity of the movable assembly, the surface of the decorative assembly member being coated with a coating;

inserting a first fastener through an aperture of the movable assembly when the decorative assembly member is inserted in the cavity of the movable assembly;

cutting through the coating of the decorative assembly member with the first fastener and contacting the surface of the decorative assembly member when the first fastener is inserted in the aperture of the movable assembly and the decorative assembly member is inserted in the cavity of the movable assembly; and removably electrically connecting a second fastener to the first fastener;

wherein the second fastener is electrically connected to the movable assembly.

13. The method of claim 12, wherein the first fastener is a threaded fastener having an abrasive end portion and the aperture is a threaded aperture.

14. The method of claim 13, wherein cutting through the coating of the decorative assembly member with the first fastener includes rotatably scraping the coating with the abrasive end portion while threading the first fastener through the aperture.

15. The method of claim 12, further comprising electrically connecting the movable assembly to the assembly via at least one ball bearing supported in an elongated cavity formed between a first recess of the movable assembly and a second recess of the assembly.

16. The method of claim 15, further comprising rotating the movable assembly while supported by the assembly and while maintaining electrical connection between the movable assembly and the assembly via the at least one ball bearing.

17. The method of claim 12, wherein an electrical wire is electrically connected between the second fastener and a third wire of a three-wire socket of the movable assembly.

18. An apparatus, comprising:

a decorative assembly stand including an assembly supporting a rotatable assembly, the rotatable assembly having a cavity;

a pole that is removably received in the cavity;

a coating that coats a surface of the pole;

a first fastener; and a second fastener that is removably electrically connected to the first fastener;

wherein the second fastener is electrically connected to the rotatable assembly;

wherein the first fastener is received in an aperture of the rotatable assembly and extends through a hole in the coating of the pole when the pole is removably received in the cavity; and wherein a jagged end portion of the first fastener contacts the surface of the pole.

19. The apparatus of claim 18, wherein the rotatable assembly is electrically connected to the assembly via at least one ball bearing supported in an elongated cavity formed between a first recess of the rotatable assembly and a second recess of the assembly.

20. The apparatus of claim 18, wherein the pole is electrically connected to a two-blade plug that is removably attachable to a socket that is electrically connected to the rotatable assembly.

* * * * *